US006103460A

United States Patent [19]

Takahashi et al.

[11] Patent Number: 6,103,460

[45] Date of Patent: Aug. 15, 2000

[54] SILVER HALIDE COLOR PHOTOGRAPHIC LIGHT-SENSITIVE MATERIAL

[75] Inventors: Osamu Takahashi; Yasuhiro Yoshioka; Shin Soejima; Yasuhiro Shimada; Masakazu Morigaki, all of Minami Ashigara, Japan

[73] Assignee: Fuji Photo Film Co., Ltd., Kanagawa, Japan

[21] Appl. No.: 09/110,849

[22] Filed: Jul. 7, 1998

[30] Foreign Application Priority Data

Jul. 7, 1997 [JP] Japan ..... 9-181488

[51] Int. Cl.[7] ..... G03C 7/32

[52] U.S. Cl. ..... 430/546; 430/551; 430/558

[58] Field of Search ..... 430/546, 551, 430/558

[56] References Cited

U.S. PATENT DOCUMENTS

| | | | |
|---|---|---|---|
| 5,330,888 | 7/1994 | Morigaki et al. . | |
| 5,474,880 | 12/1995 | Makuta . | |
| 5,866,313 | 2/1999 | Hirano | 430/551 |

FOREIGN PATENT DOCUMENTS

| | | |
|---|---|---|
| 0617322A1 | 9/1994 | European Pat. Off. . |
| 19507418A1 | 9/1996 | Germany . |

*Primary Examiner*—Janet Baxter
*Assistant Examiner*—Amanda C. Walker
*Attorney, Agent, or Firm*—Birch, Stewart, Kolasch & Birch, LLP

[57] ABSTRACT

A sliver halide color photographic light-sensitive material comprising a support having provided thereon at least one silver halide emulsion layer containing at least one cyan dye forming coupler represented by the formula (1) shown below, at least one compound represented by the formula (A) shown below and at least one compound represented by the formula (D) shown below:

(1)

wherein $Z^a$ and $Z^b$ each represents —C($R^3$)= or —N=, provided that one of $Z^a$ and $Z^b$ is —N= and the other is —C($R^3$)=; $R^1$ and $R^2$ each represents an electron attractive group having a Hammett's substituent constant $\sigma_p$ value of 0.20 or more and the sum of the $\sigma_p$ values of $R^1$ and $R^2$ is 0.65 or more; $R^3$ represents a hydrogen atom or a substituent; X represents a hydrogen atom or a group capable of being released upon a coupling reaction with an oxidation product of an aromatic primary amine color developing agent; and group represented by $R^1$, $R^2$, $R^3$ or X may be a divalent group to form a dimer or more, or combine with a polymer chain to form a homopolymer or a copolymer;

(A)

(D)

The silver halide color photographic light-sensitive material provides color images excellent in color reproducibility and color image fastness.

20 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material. More particularly, the present invention relates to a silver halide color photographic light-sensitive material which contains a diffusion-resistant cyan dye forming coupler in a silver halide emulsion layer thereof and provides color images excellent in color reproducibility and color image fastness by processing with a color developer containing a color developing agent.

BACKGROUND OF THE INVENTION

It is well known that in a silver halide color photographic light-sensitive material an aromatic primary amine color developing agent oxidized with an exposed silver halide reacts with a coupler to form a dye such as an indophenol, an indoaniline, an indamine, an azomethine, a phenoxazine, a phenazine or a like dye, whereby a color image is formed. In this photographic system, a subtractive color process is ordinarily employed for color reproduction and color images are formed by yellow, magenta and cyan dyes.

Among them, in order to form cyan dye images, phenolic or naphtholic couplers are generally employed. However, these couplers have a problem in that color reproducibility is deteriorated since dyes formed therefrom have undesirable absorption in blue and green regions. Accordingly, it has been desired to solve such a problem.

In order to solve this problem, heterocyclic compounds have been proposed as described in U.S. Pat. Nos. 4,728,598 and 4,873,183 and European Patent 0249453A2. These couplers have, however, other problems in that they have a low coupling activity and in that fastness of dyes formed therefrom are very poor.

Pyrrolotriazole couplers have been proposed in U.S. Pat. No. 5,256,526 and European Patent 0545300 as couplers for solving the above-described problems. Although these couplers are excellent in hue and coupling activity, fastness of dye images formed therefrom is not sufficient. Particularly, light fastness is inferior compared with conventional phenolic couplers. Further, they are very liable to create color mixing during processing (cyan color mixing in a magenta color image or a yellow color image) caused by their high coupling activity and large molar absorption coefficient of dyes formed therefrom in comparison with conventional phenolic couplers. Hence, improvements in these problems have been desired.

SUMMARY OF THE INVENTION

Therefore, an object of the present invention is to provide a silver halide color-photographic light-sensitive material capable of forming cyan dye images excellent in both color reproducibility and color image fastness.

Other objects of the present invention will be apparent rom the following detailed description and examples.

As a result of intensive investigations to solve the above described problems, it has been found that the above described objects can be accomplished by a sliver halide color photographic light-sensitive material comprising a support having provided thereon at least one silver halide emulsion layer containing at least one cyan dye forming coupler represented by the formula (1) shown below, at least one compound represented by the formula (A) shown below and at least one compound represented by the formula (D) shown below:

(1)

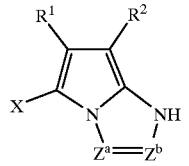

wherein $Z^a$ and $Z^b$ each represents —C($R^3$)= or —N=, provided that one of $Z^a$ and $Z^b$ is —N= and the other is —C($R^3$)=; $R^1$ and $R^2$ each represents an electron attractive group having a Hammett's substituent constant $\sigma_p$ value of 0.20 or more and the sum of the $\sigma_p$ values of $R^1$ and $R^2$ is 0.65 or more; $R^3$ represents a hydrogen atom or a substituent; X represents a hydrogen atom or a group capable of being released upon a coupling reaction with an oxidation product of an-aromatic primary amine color developing agent; and group represented by $R^1$, $R^2$, $R^3$ or X may be a divalent group to form a dimer or more, or combine with a polymer chain to form a homopolymer or a copolymer;

(A)

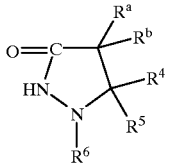

wherein $R^a$ and $R^b$, which may be the same or different, each represents a substituted or unsubstituted aryl group or a substituted or unsubstituted alkyl group having the total number of carbon atoms including the substituent(s) of from 2 to 30; $R^4$ and $R^5$, which may be the same or different, each represents a hydrogen atom, a substituted or unsubstituted alkyl group or a substituted or unsubstituted aryl group; and $R^6$ represents a substituted or unsubstituted aryl group;

(D)

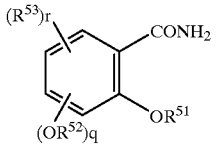

wherein $R^{51}$ and $R^{52}$ each represents a substituted or unsubstituted alkyl group, a substituted or unsubstituted aryl group, a substituted or unsubstituted acyl group, a substituted or unsubstituted carbamoyl group or a substituted or unsubstituted alkoxycarbonyl group; $R^{53}$ represents a halogen atom, a substituted or unsubstituted alkyl group, a substituted or unsubstituted aryl group, a substituted or unsubstituted acyl group, a substituted or unsubstituted carbamoyl group, a substituted or unsubstituted alkoxycarbonyl group, a substituted or unsubstituted sulfonyl group or a substituted or unsubstituted sulfamoyl group; at least one of $R^{51}$, $R^{52}$ and $R^{53}$ is or contains as a substituent a diffusion-resistant group having from 8 to 22 carbon atoms; q represents an integer of from 0 to 2; r represents an integer of from 0 to 4; and provided that the sum of q and r is 4 or less.

DETAILED DESCRIPTION OF THE INVENTION

Now, the Hammett's substituent constant $\sigma_p$ value used in the present invention will be explained below.

The Hammett's rule is an empirical rule which was proposed by L. P. Hammett in 1935 in order to quantitatively examine an effect of a substituent on a reaction or equilibrium of a benzene derivative and its propriety is widely admitted at present.

The substituent constants obtained by the Hammett's rule include $\sigma_p$ values and $\sigma_m$ values and these values are described in detail in many references, for example, J. A. Dean (Ed.) *Lance's Handbook of Chemistry,* 12th Edition (McGraw Hill, 1979) and *Kagaku no Ryoiki Zokan*, Vol. 122, pages 96 to 103 (Nankodo, 1979).

In the present invention, each substituent on the cyan dye forming coupler is defined by the Hammett's substituent constant $\sigma_p$ value. However, it should be noted that the substituents are not limited to those having their known values described in references, and include substituents having the Hammett's substituent constant $\sigma_p$ value within the above described range when determined based on the Hammett's rule, even if the values of the substituents are not described in references. Although the compound represented by the formula (1) is not a benzene derivative, the $\sigma_p$ value is utilized as a measure for indicating electron effect of a substituent in spite of the substitution position thereof. In the present invention, the $\sigma_p$ value is employed in such a sense hereinafter.

The term "oleophilict" used in the present invention means that the solubility of a compound in question in water is 10% or less at room temperature.

In the specification, an aliphatic group may be straight chain, branched chain or cyclic, or saturated or unsaturated, and includes an alkyl group, an alkenyl group, an alkynyl group, a cycloalkyl group and a cycloalkenyl group. The aliphatic group may have one ore more substituents. An aromatic group represents an aryl group and may have one or more substituents. A heterocyclic group is a cyclic group containing one ore more hetero atoms in its ring and includes an aromatic heterocyclic group. The heterocyclic group may have one ore more substituents. A substituent including the substituent on the aliphatic, aromatic or heterocyclic group may be any group capable of substituting as far as otherwise indicated, and includes, for example, an aliphatic group, an aromatic group, a heterocyclic group, an acyl group, an acyloxy group, an acylamino group, an aliphatic oxy group, an aromatic oxy group, a heterocyclic oxy group, an aliphatic oxycarbonyl group, an aromatic oxycarbonyl group, a heterocyclic oxycarbonyl group, an aliphatic carbamoyl group, an aromatic carbamoyl group, an aliphatic sulfonyl group, an aromatic sulfonyl group, an aliphatic sulfamoyl group, an aromatic sulfamoyl group, an aliphatic sulfonamido group, an aromatic sulfonamido group, an aliphatic amino group, an aromatic amino group, an aliphatic sulfinyl group, an aromatic sulfinyl group, an aliphatic thio group, an aromatic thio group, a mercapto group, a hydroxy group, a cyano group, a nitro group, a hydroxyamino group and a halogen atom.

Now, the cyan dye forming coupler represented by the formula (1) used in the present invention will be described in more detail below.

In the formula (1), $Z^a$ and $Z^b$ each represents —C($R^3$)= or —N=, provided that one of $Z^a$ and $Z^b$ is —N= and the other is —C($R^3$)=.

$R^3$ represents a hydrogen atom or a substituent. The substituent includes, for example, a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, and an acyl group. These groups may be further substituted with substituent(s) same as those described for $R^3$.

More specifically, $R^3$ represents a hydrogen atom, a halogen atom (e.g., chlorine, or bromine), an alkyl group (for example, a straight chain or branched chain alkyl group having from 1 to 32 carbon atoms, an aralkyl group, an alkenyl group, an alkynyl group, a cycloalkyl group, or a cycloalkenyl group including, e.g., methyl, ethyl, propyl, isopropyl, tert-butyl, tridecyl, 2-methanesulfonylethyl, 3-(3-pentadecylphenoxy)-propyl, 3-[4-{2-[4-[(4-hydroxyphenylsulfonyl)phenoxy]-dodecanamido}yphenyl] propyl, 2-ethoxytridecyl, trifluoromethyl, cyclopentyl, or 3-(2,4-di-tert-amylphenoxy)propyl), an aryl group (e.g., phenyl, 4-tert-butylphenyl, 2,4-di-tert-amylphenyl, or 4-tetradecanamidophenyl), a heterocyclic group (e.g., imidazolyl, pyrazolyl, triazolyl, 2-furyl, 2-thienyl, 2-pyrimidinyl, or 2-benzothiazolyl), a cyano group, a hydroxy group, a nitro group, a carboxy group, an amino group, an alkoxy group (e.g., methoxy, ethoxy, 2-methoxyethoxy, 2-dodecyloxyethoxy, or 2-methanesulfonylethoxy), an aryloxy group (for example, phenoxy, 2-methylphenoxy, 4-tert-butylphenoxy, 3-nitrophenoxy, 3-tert-butyloxycarbamoylphenoxy, or 3-methoxycarbamoylphenoxy), an acylamino group (e.g., acetamido, benzamido, tetradecanamido, 2-(2,4-di-tert-amylphenoxy)butanamido, 4-(3-tert-butyl-4-hydroxyphenoxy)-butanamido, or 2-[4-[(4-hydroxyphenylsulfonyl)phenoxy]-decanamido), an alkylamino group (e.g., methylamino, butylamino, dodecylamino, diethylamno, or methylbutylamino, an arylamino group (e.g., phenylamino, 2-chloroanilino, 2-chloro-5-tetradecanaminoanilino, 2-chloro-5-dodecyloxycarbonylanilino, N-acetylanilino, or 2-chloro-5-[2-(3-tert-butyl-4-hydroxyphenoxy)dodecanamido]anilino), a ureido group (e.g., phenylureido, methylureido, or N,N-dibutylureido), a sulfamoylamino group (e.g., N,N-dipropylsulfamoylamino, or N-methyl-N-decylsulfamoylamino), an alkylthio group (for example, methylthio, octylthio, tetradecylthio, 2-phenoxyethylthio, 3-phenoxypropylthio, or 3-(4-tert-butylphenoxy) propylthio), an arylthio group (e.g., phenylthio, 2-butoxy-5-tert-octylphenylthio, 3-pentadecylphenylthio, 2-carboxyphenylthio, or 4-tetradecanamidophenylthio), an alkoxycarbonylamino group (e.g., methoxycarbonylamino, or tetradecyloxycarbonylamino), a sulfonamido group (e.g., methanesulfonamido, hexadecanesulfonamido, benzenesulfonamido, p-toluenesulfonamido, octadecanesulfonamido, or 2-methoxy-5-tert-butylbenzenesulfonamido), a carbamoyl group (e.g., N-ethylcarbamoyl, N,N-dibutylcarbamoyl, N-(2-dodecyloxy-ethyl)carbamoyl, N-methyl-N-dodecylcarbamoyl, or N-[3-(2,4-di-tert-amylphenoxy) propyl]carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl), a sulfonyl group (e.g., methanesulfonyl, octanesulfonyl, benzenesulfonyl, or toluenesulfonyl), an alkoxycarbonyl group (e.g., methoxycarbonyl, butoxycarbonyl, dodecyloxycarbonyl, or octadecyloxycarbonyl), a heterocyclic oxy group (e.g., 1-phenyltetrazolyl-5-oxy, or 2-tetrahydropyranyloxy), an azo group (e.g., phenylazo, 4-methoxyphenylazo, 4-pivaloylaminophenylazo, or 2-hydroxy-4-propanoylphenylazo), an acyloxy group (e.g., acetoxy), a carbamoyloxy group (e.g., N-methylcarbamoyloxy, or N-phenylcarbamoyloxy), a silyloxy group (e.g., trimethylsilyloxy, or dibutylmethylsilyloxy), an aryloxycarbonylamino group (e.g., phenoxycarbonylamino), an imido group (e.g., N-succinimido, N-phthalimido, or 3-octadecenylsuccinimido), a heterocyclic thio group (e.g., 2-benzothiazolylthio, 2,4-di-phenoxy-1,3,5-triazolyl-6-thio, or 2-pyridylthio), a sulfinyl group (e.g., dodecanesulfinyl, 3-pentadecylphenylsufinyl, or 3-phenoxypropylsulfinyl), a phosphonyl group (e.g., phenoxyphosphonyl, octyloxyphosphonyl, or phenylphosphonyl), an aryloxycarbonyl group (e.g., phenoxycarbonyl), or an acyl group (e.g., acetyl, 3-phenylpropanoyl, benzoyl, or 4-dodecyloxybenzoyl).

$R^3$ preferably represents an alkyl group, an aryl group, a heterocyclic group, a cyano group, a nitro group, an acylamino group, an arylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, or an acyl group.

More preferably, $R^3$ represents an alkyl group or an aryl group. $R^3$ more preferably represents an alkyl group or aryl group each having at least one substituent in view of cohesion. Further preferably $R^3$ represents an alkyl group or aryl group each having at least one alkyl group, alkoxy group, sulfonyl group, sulfamoyl group, carbamoyl group, acylamido group, or sulfonamido group as a substituent. $R^3$ particularly preferably represents an.alkyl group or aryl group each having at least one alkyl group, acylamido group or sulfonamido group as a substituent. Where $R_3$ is an aryl group, the substituent is more preferably present at least at an ortho position or a para position thereof.

In the cyan dye forming coupler represented by the formula (1) according to the present invention, it is defined that $R^1$ and $R^2$ each represents an electron attractive group having a Hammett's substituent constant $\sigma_p$ value of 0.20 or more and the sum of the $\sigma_p$ values of $R^1$ and $R^2$ is 0.65 or more to form a cyan dye image upon color development.

The sum of the $\sigma_p$ values of $R^1$ and $R^2$ is preferably not less than 0.70, and the upper limit thereof is about 1.8.

$R^1$ and $R^2$ each represents an electron attractive group having a Hammett's substituent constant $\sigma_p$ value of 0.20 or more, preferably 0.30 or more. The upper limit thereof is 1.0 or less.

Suitable examples of the electron attractive group having the $\sigma_p$ value of not less than 0.20 include an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having the $\sigma_p$ value of 0.20 or more, a heterocyclic group, a halogen atom, an azo group, and a selenocyanate group.

Of these substituents, those capable of having a substituent may further have substituent(s) as described for $R^3$ above.

More specifically, the electron attractive group having the $\sigma_p$ value of not less than 0.20 includes an acyl group (e.g., acetyl, 3-phenylpropanoyl, benzoyl, or 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido) penylcarbamoyl, N-methyl-N-dodecylcarbamoyl, or N-[3-(2,4-di-tert-amylphenoxy)propyl]carbamoyl), an alkoxycarbonyl group (e.g., methoxycarbonyl, ethoxycarbonyl, isopropyloxy carbonyl, tert-butyloxycarbonyl, isobutyloxycarbonyl, butyloxycarbonyl, dodecyloxycarbonyl, or octadecyloxycarbonyl), an aryloxycarbonyl group (e.g., phenoxycarbonyl), a cyano group, a nitro group, a dialkylphosphono group (e.g., dimethylphosphono), a diarylposphono group (e.g., diphenylphosphono), a . diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g, mothanesulfonyl, or octanesulfonyl), an arylsulfonyl group (e.g., benzenesulfonyl, or toluenesulfonyl), a sulfonyloxy group (e.g., methanesulfonyloxy, or toluenesulfonyloxy), an acylthio group (e.g., acetylthio, or benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl), a thiocyanate group, a thiocarbonyl group (e.g., methylthiocarbonyl, or phenylthiocarbonyl), a halogenated alkyl group (e.g., trifluoromethyl, or heptafluoropropyl), a halogenated alkoxy group (e.g., trifluoromethoxy), a halogenated aryloxy group (e.g., pentafluorophenoxy), a halogenated alkylamino group (e.g., N,N-di-(trifluoromethyl)amino), a halogenated alkylthio group (e.g., difluoromethylthio, or 1,1,2,2-tetrafluoroethylthio), an aryl group substituted with an electron attractive group having the $\sigma_p$ value of not less than 0.20 (e.g., 2,4-dinitrophenyl, 2,4,6-trichlorophenyl, or pentachlorophenyl), a heterocyclic group (e.g., 2-benzoxazolyl, 2-benzothiazolyl, 1-phenyl-2-benzimidazolyl, 5-chloro-1-tetrazolyl, or 1-pyrrolyl), a halogen atom (e.g., chlorine, or bromine), an azo group (e.g., phenylazo), and a selenocyanate group. Of these substituents, those capable of having a substituent may further have substituent(s) as described far $R^3$ above.

Preferred groups represented by $R^1$ or $R^2$ include an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, an aryl group substituted with at least two electron attractive groups having the $\sigma_p$ value of not less than 0.20, and a heterocyclic group. More preferred groups include an alkoxycarbonyl group, a nitro group, a cyano group, an arylsulfonyl group, a carbamoyl group, and a halogenated alkyl group. $R^1$ most preferably represents a cyano group. $R^2$ particularly preferably represents an alkoxycarbonyl group, and most preferably represents a branched chain alkoxycarbonyl group (in particular, a cycloalkoxycarbonyl group).

X represents a hydrogen atom or a group capable of being released upon a coupling reaction with an oxidation product of an aromatic primary amine color developing agent. The group capable of being released includes a halogen atom, an alkoxy group, an aryloxy group, an acyloxy group, an alkyl or aryl sulfonyloxy group, an acylamino group, an alkyl or aryl sulfonamido group, an alkoxycarbonyloxy group, an aryloxycarbonyloxy group, an alkyl, aryl or heterocyclic thio group, a carbamoylamino group, a carbamoyloxy group, a heterocyclic carbonyloxy group, a 5-membered or 6-membered nitrogen-containing heterocyclic group, an imido group, and an arylazo group. These groups may be further substituted with substituent(s) as described for $R^3$ above.

More specifically, the group capable of being released for X includes a halogen atom (e.g., fluorine, chlorine, or bromine), an alkoxy group (e.g., ethoxy, dodecyloxy, methoxyethylcarbamoylmethoxy, carboxypropyloxy, methylsulfonylethoxy, or ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, or 2-carboxyphenoxy), an acyloxy group (e.g., acetoxy, tetradecanoyloxy, or benzoyloxy), an alkyl or aryl sulfonyloxy group (e.g., methanesulfonyloxy, or toluenesulfonyloxy), an acylamino group (for example, dichloroacetylamino, or heptafluorobutyrylamino), an alkyl or aryl sulfonamido group (e.g., methanesulfonamido, trifluoromethanesulfonamido, or p-toluenesulfonamido), an alkoxycarbonyloxy group (e.g., ethoxycarbonyloxy, or benzyloxycarbonyloxy) an aryloxycarbonyloxy group (e.g., phenoxycarbonyloxy), an alkyl, aryl or heterocyclic thio group (e.g., dodecylthio, 1-carboxydodecylthio, phenylthio, 2-butoxy-5-tert-octylphenylthio, or tetrazolylthio), a carbamoylamino group (e.g., N-methylcarbamoylamino, or N-phenylcarbamoylamino), a carbamoyloxy group (e.g., N,N-diethylcarbamoyloxy, N-ethylcarbamoyloxy, or N-ethyl-N-phenylcarbamoyloxy), a heterocyclic carbonyloxy group (e.g., morpholino carbonyloxy, or piperidinocarbonyloxy), a 5-membered or 6-membered nitrogen-containing heterocyclic group (e.g., imidazolyl, pyrazolyl, triazolyl, tetrazolyl, or 1,2-dihydro-2-oxo-1-pyridyl), an imido group (e.g., succinimido, or hydantoinyl), and an arylazo group (e.g., phenylazo, or 4-methoxyphenylazo).

X further represents a releasing group bonded through a carbon atom. In such a case, the coupler may form a bis type coupler obtained by condensation of a 4-equivalent copular with an aldehyde or a ketone. Moreover, x may contain a photographically useful group, for example, a group of development inhibitor or development accelerator.

Preferred groups for X include a halogen atom, an alkoxy group, an aryloxy group, an alkyl or aryl thio group, an alkoxycarbonyloxy group, an aryloxycarbonyloxy group, a carbamoyloxy group, a heterocyclic carbonyloxy group, and a 5-membered or 6-membered nitrogen-containing heterocyclic group bonded to the coupling active position through the nitrogen atom. More preferably, X represents a halogen atom, an alkyl or aryl thio group, an alkoxycarbonyloxy group, an aryloxycarbonyloxy group, a carbamoyloxy group, or a heterocyclic carbonyloxy group. Particularly preferably X represents a carbamoyloxy group or a heterocyclic carbonyloxy group.

In the cyan dye forming copular represented by the formula (1), the group represented by $R^1$, $R^2$, $R^3$ or X may be a divalent group to form a dimer or more, or combine with a polymer chain to form a homopolymer or a copolymer. A typical example of a homopolymer or a copolymer formed by combining with a polymer chain includes a homopolymer or a copolymer of an addition polymerizable ethylenically unsaturated compound which has a cyan coupler residue represented by the formula (1). In this case, one or more kinds of a cyan color forming repeating unit having a cyan coupler residue represented by the formula (1) may be contained in the polymer and one or more kinds of a non-color forming ethylene type monomer may be contained therein as a copolymerization component. The cyan color forming repeating unit having a cyan coupler residue represented by the formula (1) is preferably represented by the following formula (P):

(P)

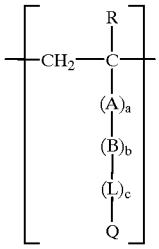

wherein R represents a hydrogen atom, an alkyl group having from 1 to 4 carbon atoms, or a chlorine atom; A represents —CONH—, —COO—, or a substituted or unsubstituted phenylene group; B represents a substituted or unsubstituted alkylene group, a substituted or unsubstituted phenylene group or a substituted or unsubstituted alkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$—, or —$SO_2NH$—; a, b and c each represents 0 or 1; and Q represents a cyan coupler residue formed by eliminating a hydrogen atom from $R^1$, $R^2$, $R^3$ or X in the compound represented by the formula (1).

A preferred polymer is a copolymer of a cyan color forming monomer corresponding to the cyan color forming repeating unit represented by the formula (P) and a non-color forming ethylene type monomer which is not capable of coupling with an oxidation product of an aromatic primary amine developing agent.

Suitable examples of the non-color forming ethylene type monomers which are not capable of coupling with an oxidation product of an aromatic primary amine developing agent include, for example, acrylic acid, α-chloroacrylic acid, α-alkylacrylic acid (for example, methacrylic acid), an amide or ester derived from these acrylic acids (for example, acrylamide, methacrylamide, n-butylacrylamide, tert-butylacrylamide, diacetone acrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methylmethacrylate, ethyl methacrylate, n-butyl methacrylate, and p-hydroxy methacrylate), a vinyl ester (for example, vinyl acetate, vinyl propionate, and vinyl laurate), acrylonitrile, methacrylonitrile, an aromatic vinyl compound (for example, styrene and a derivative thereof, for example, vinyl toluene, divinylbenzene, vinyl acetophenone, and sulfostyrene), itaconic acid, citraconic acid, crotonic acid, vinylidene chloride, a vinyl alkyl ether (for example, vinyl ethyl ether), a maleic acid ester, N-vinyl-2-pyrrolidone, N-vinylpyridine, and 2- or 4-vinylpyridine.

Particularly preferred non-color forming ethylene type monomers are an acrylic acid ester, a methacrylic acid ester, and a maleic acid ester. The non-color forming ethylene type monomer can be used in combination of two or more kinds of monomers. For example, it is suitable to use, in combination, methyl acrylate and butyl acrylate, butyl acrylate and styrene, butyl methacrylate and methacrylic acid, and methyl acrylate and diacetone acrylamide.

As is well known in the polymer coupler art, the ethylene type unsaturated monomer which can be copolymerized with the vinyl type monomer corresponding to the cyan color forming repeating unit represented by the formula (P) can be selected so that the physical properties and/or chemical properties of the copolymer formed, for example, solubility, compatibility with a binder for a photographic colloid composition, such as gelatin, flexibility and thermal stability, are favorably affected.

In order to incorporate the cyan dye forming coupler according to the present invention into a silver halide photographic material, preferably a red-sensitive silver halide emulsion layer, it is preferred that the cyan coupler is a so-called coupler-in-emulsion type coupler. For such a purpose, at least one of the groups represented by $R^1$, $R^2$, $R^3$ and X is preferably a so-called ballast group (preferably having 10 or more total carbon atoms, more preferably 10 to 50 total carbon atoms). In particular, $R^3$ is preferably the ballast group.

Of the cyan dye forming couplers represented by the formula (1), compounds having a structure represented by the formula (4) shown below are more preferred.

(4)

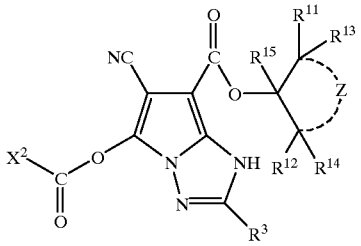

wherein $R^{11}$, $R^{12}$, $R^{13}$, $R^{14}$ and $R^{15}$, which may be the same or different, each represents a hydrogen atom or a substituent; Z represents a non-metallic atom necessary to form a 5-membered to 8-membered ring; $R^3$ represents a hydrogen atom or a substituent; and $X^2$ represents a hydrogen atom or a substituent.

In more detail, in the formula (4), the substituent represented by $R^{11}$, $R^{12}$, $R^{13}$, $R^{14}$ or $R^{15}$ is preferably a substituted or unsubstituted alkyl group or a substituted or unsubstituted aryl group.

More specifically, $R^{11}$ and $R^{12}$ each preferably represents an aliphatic group, for example, a straight chain, branched chain or cyclic aliphatic group having from 1 to 36 carbon atoms such as an alkyl group, an aralkyl group, an alkenyl group, an alkinyl group, a cycloalkyl group, or a cycloalkenyl group, specifically, e.g., methyl, ethyl, propyl, isopropyl, tert-butyl, tert-amyl, tert-octyl, tridecyl, cyclopentyl or cyclohexyl. More preferably, the aliphatic group has from 1 to 12 carbon atoms. $R^{13}$, $R^{14}$ and $R^{15}$ each preferably represents a hydrogen atom or an aliphatic group. The aliphatic group is the same as that defined for $R^{11}$ or $R^{12}$ above. $R^{13}$, $R^{14}$ and $R^{15}$ each preferably represents a hydrogen atom.

Z represents a non-metallic atomic group necessary to form a 5-membered to 8-membered ring, the ring may be substituted, or may be a saturated ring, or may contain an unsaturated bond. Preferred non-metallic atoms include a nitrogen atom, an oxygen atom, a sulfur atom or a carbon atom, more preferably a carbon atom.

Examples of the ring formed by Z include, e.g., a cyclopentane ring, a cyclohexane ring, a cycloheptane ring, a cyclooctane ring, a cyclohexene ring, a piperazine ring, an oxane ring and a thiane ring, and the ring may be substituted with substituent(s) as defined for $R^3$ described below.

The preferred ring formed by Z is a cyclohexane ring which may be substituted, and the particularly preferred ring is a cyclohexane ring substituted with an alkyl group having from 1 to 24 carbon atoms at the 4-position thereof (which may be substituted with substituent(s) as defined for $R^3$ described below).

The substituent represented by $R^3$ in the formula (4) is the same as that defined for $R^3$ in the formula (1) above. $R^3$ preferably represents an alkyl group or an aryl group, and more preferably a substituted aryl group. With respect to the number of carbon atoms included, the alkyl group preferably has from 1 to 36 carbon atoms, and the aryl group preferably has from 6 to 36 carbon atoms.

Among the aryl groups, those substituted with an alkoxy group at the ortho position to the position bonding to the coupler skeleton are not preferred since light fastness of dyes formed these couplers is poor.

As the substituent for the aryl group, a substituted or unsubstituted alkyl group is preferred, and an substituted alkyl group is more preferred. An unsubstituted alkyl group having from 1 to 30 carbon atoms is particularly preferred.

The substituent represented by $X^2$ is preferably a group capable of accelerating release of the $X^2$—C (=O)O— group at th e time of oxidized coupling reaction.

$X^2$ preferably represents a heterocyclic group, an unsubstituted or substituted amino group or an aryl group. A heterocyclic ring for forming the heterocyclic group represented by $X^2$ is preferably a 5-membered to 8-membered ring containing a nitrogen atom, an oxygen atom or a sulfur atom as a hetero atom and having from 1 to 36 carbon atoms. A 5-membered or 6-membered nitrogen-containing heterocyclic ring which is connected to the carbonyl group through the nitrogen atom is more preferred. Among others, the 6-membered nitrogen-containing heterocyclic ring connecting through the nitrogen atom is particularly preferred. The ring may form a condensed ring together with a benzene ring or a heterocyclic ring.

Specific examples of the heterocyclic ring include imidazole, pyrazole, triazole, a lactam compound, piperidine, pyrrolidine, pyrrole, morpholine, pyrazolidine, thiazolidine and pyrazoline. Preferred rings are morpholine and piperidine, and morpholine is particularly preferred.

A substituent for the substituted amino group include an aliphatic group, an aryl group and a heterocyclic group. Suitable examples of the aliphatic group include those described for $R^3$ above. The aliphatic group may be substituted with a cyano group, an alkoxy group (e.g., methoxy), an alkoxycarbonyl group (e.g., ethoxycarbonyl), a chlorine atom, a hydroxy group or a carboxyl group. Of the substituted amino groups, a disubstituted amino group is more preferred than a monosubstituted amino group. As the substituent, an alkyl group is preferred.

The aryl group has preferably from 6 to 36 carbon atoms. A monocyclic aryl group is more preferred. Specific examples of the aryl group include a phenyl, 4-tert-butylphenyl, 2-methylphenyl, 2,4,6-trimethylphenyl, 2-methoxyphenyl, 4-methoxyphenyl, 2,6-dichlorophenyl, 2-chlorophenyl or 2,4-dichlorophenyl group.

It is preferred that the cyan dye forming coupler represented by the formula (4) according to the present invention has an oil-solubilizing group in its molecule to easily soluble in an organic solvent having a high boiling point and that the coupler per se and a dye formed therefrom upon the oxidized coupling reaction between the coupler and a reducing agent for color formation, i.e., a developing agent are diffusion-resistant in a hydrophilic colloid layer of the photographic material.

The coupler represented by the formula (4) may be a dimer or more, in which $R^3$ contains a residue of the coupler represented by the formula (4), or may be a homopolymer or a copolymer, in which $R^3$ contains a polymer chain. Typical examples of the homopolymer or copolymer include homopolymers or copolymers formed from an addition polymerizable ethylenically unsaturated compound having a residue of the coupler represented by the formula (4). Such polymers may contain one or more kinds of a cyan color forming repeating unit containing a residue of the coupler represented by the formula (4). The copolymers may contain one or more non-color forming ethylenic monomers which do not couple with an oxidation product of an aromatic primary amine developing agent, such as acrylic acid esters, methacrylic acid esters or maleic acid esters, as copolymerization components.

Specific examples of the cyan dye forming coupler used in the present invention are set forth below, but the present invention should not be construed as being limited thereto.

(1)

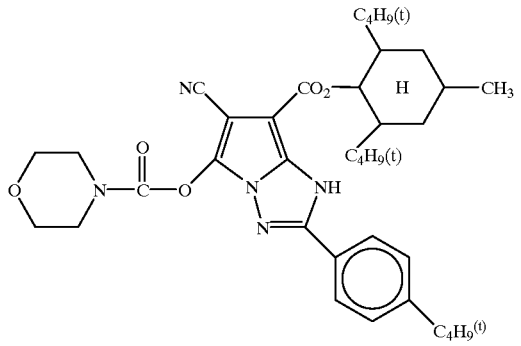

(2)

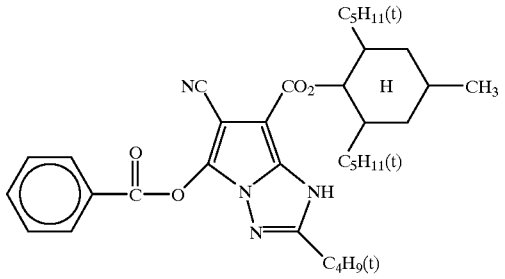

(3)

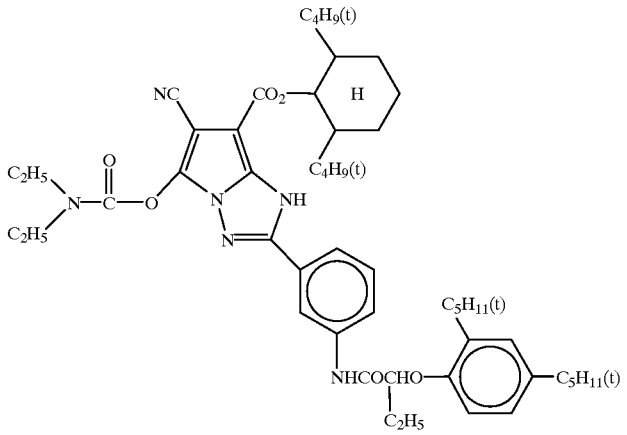

-continued
(4)
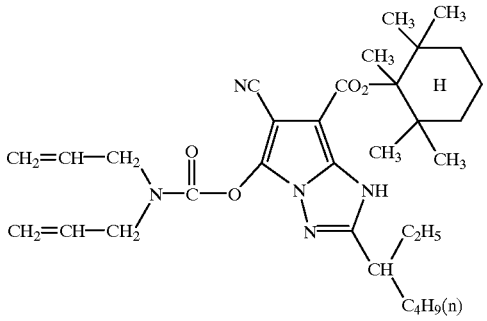
(5)
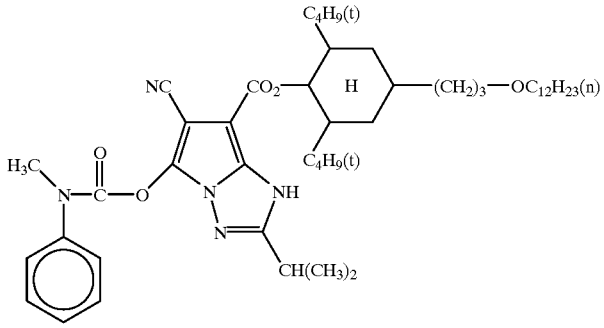
(6)
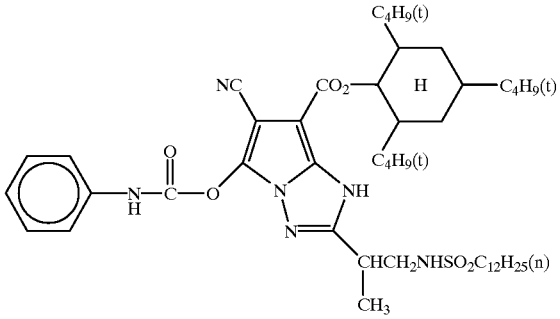
(7)
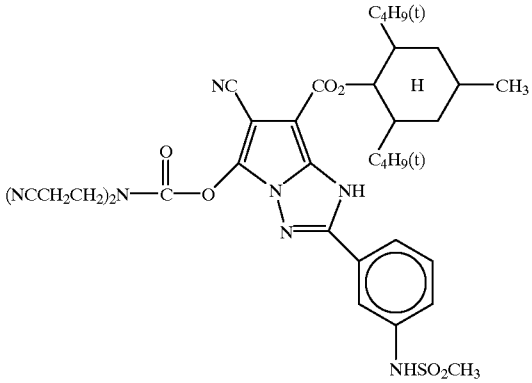

-continued
(8)
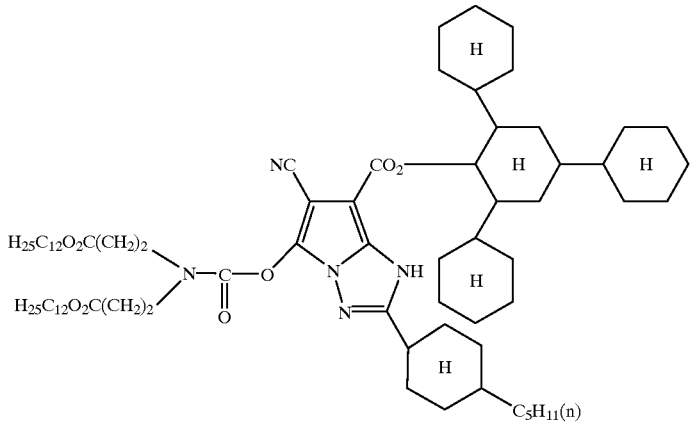
(9)
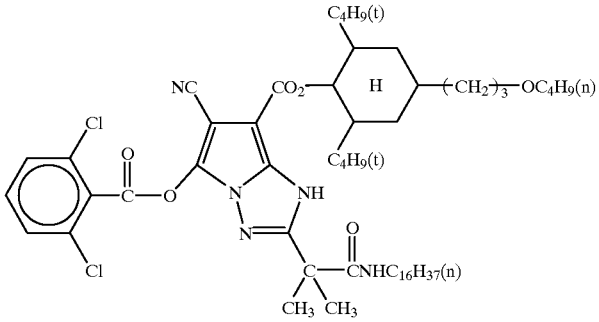
(10)
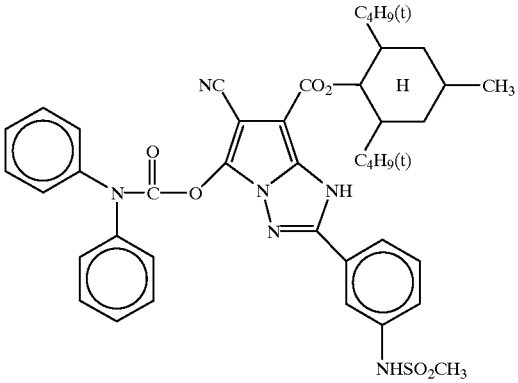
(11)
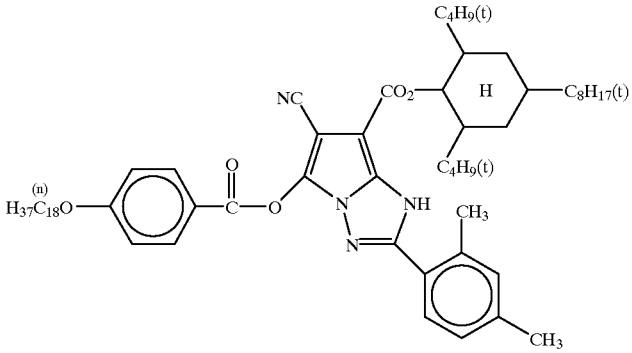

-continued
(12)
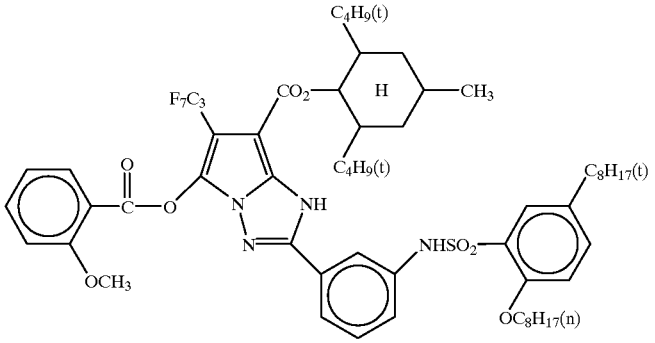
(13)
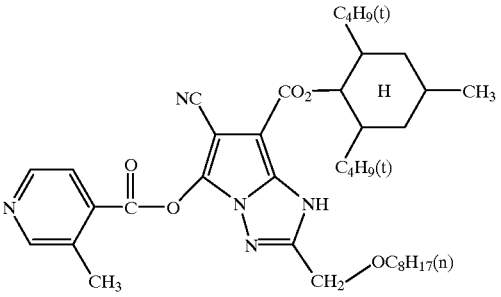
(14)
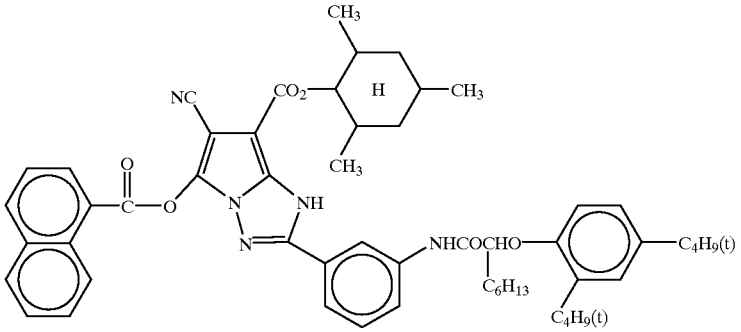
(15)
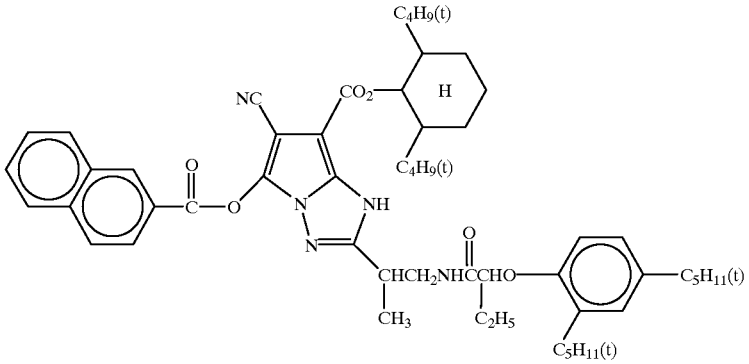

-continued
(16)
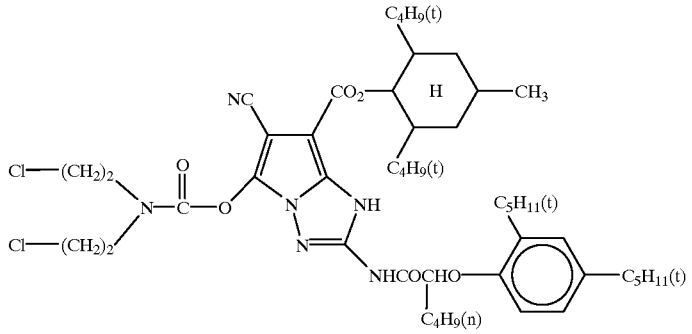
(17)
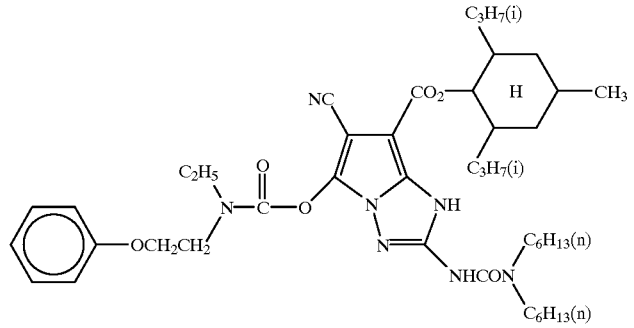
(18)
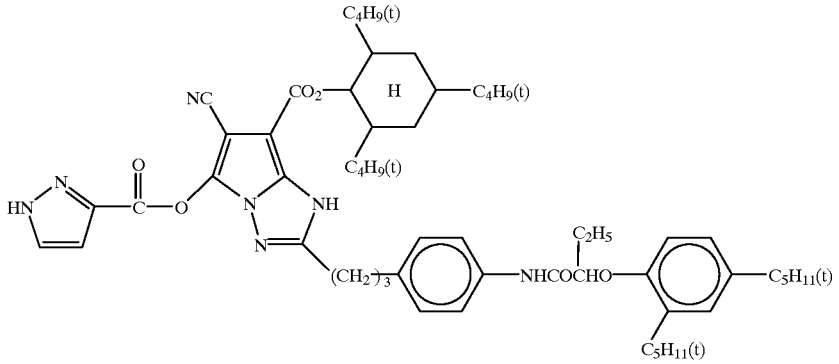
(19)
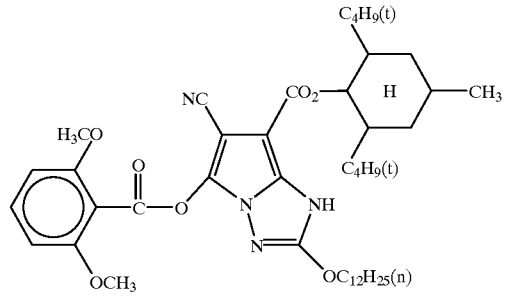

-continued
(20)
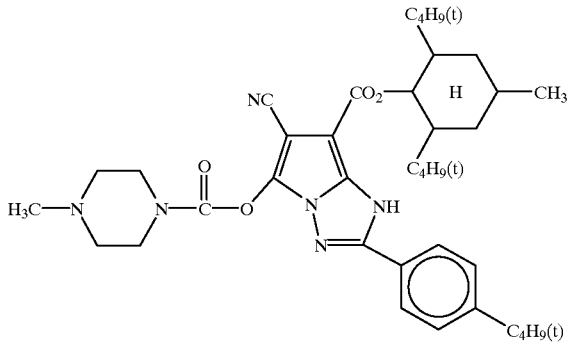
(21)
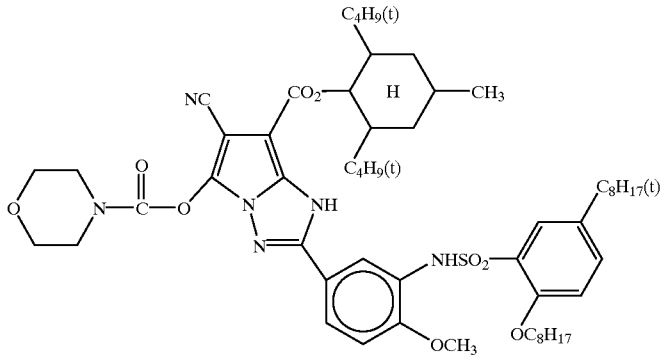
(22)
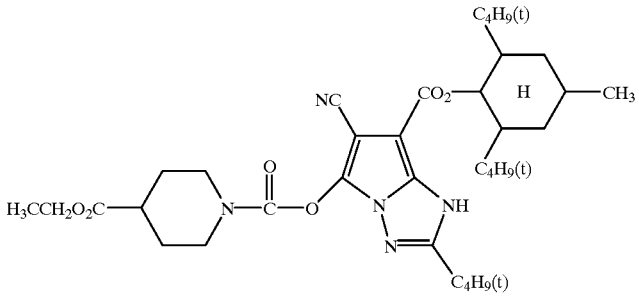
(23)
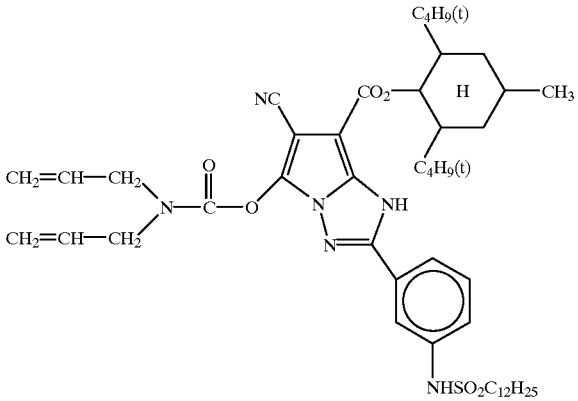

-continued
(24)
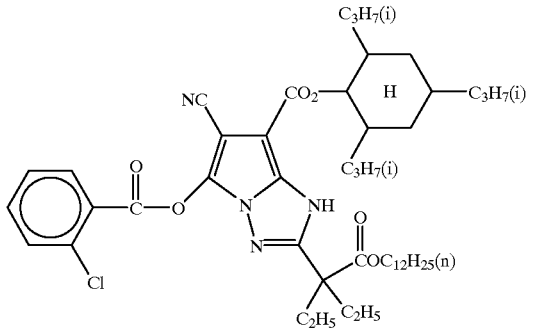
(25)
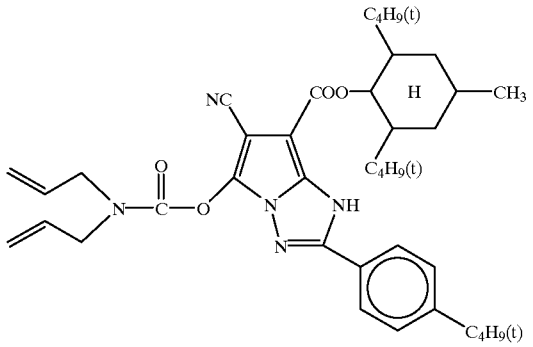
(26)
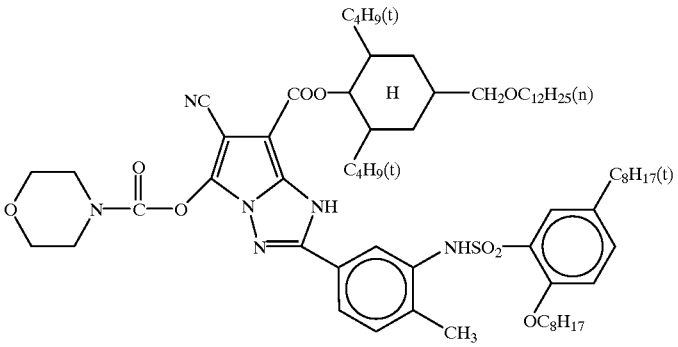
(27)
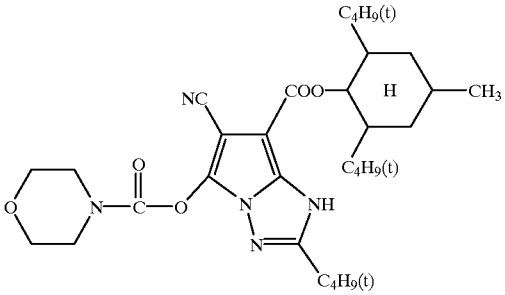

-continued
(28)
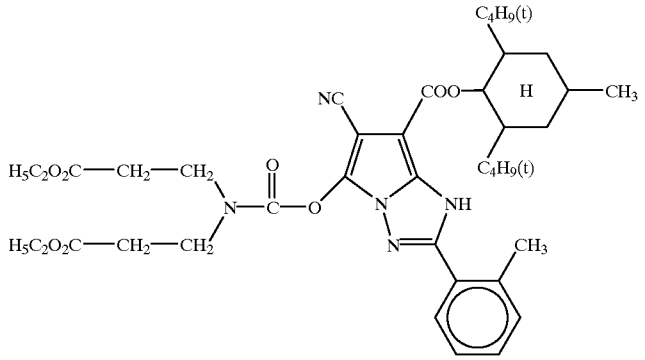
(29)
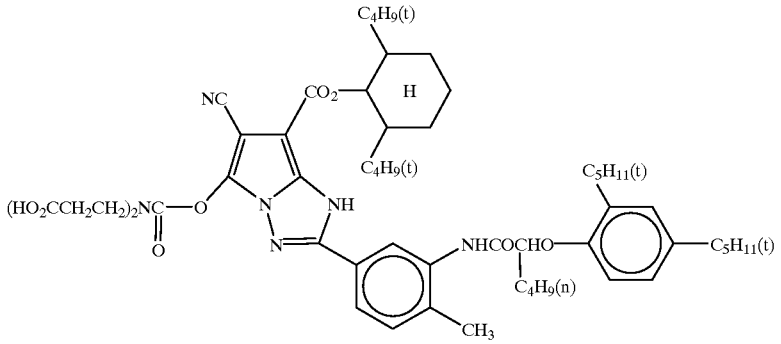
(30)
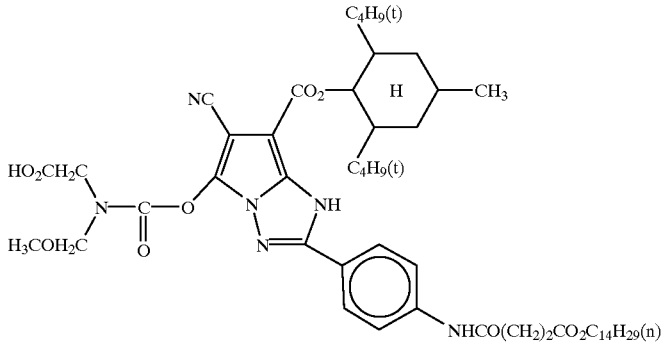
(31)
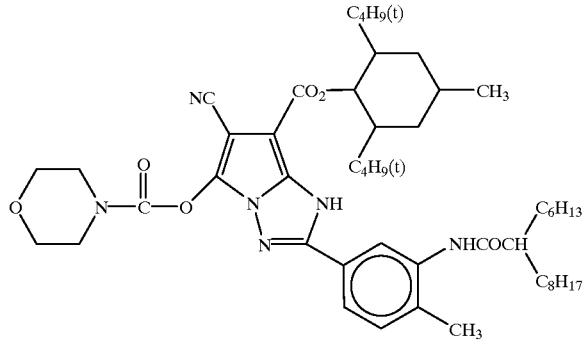

-continued
(32)
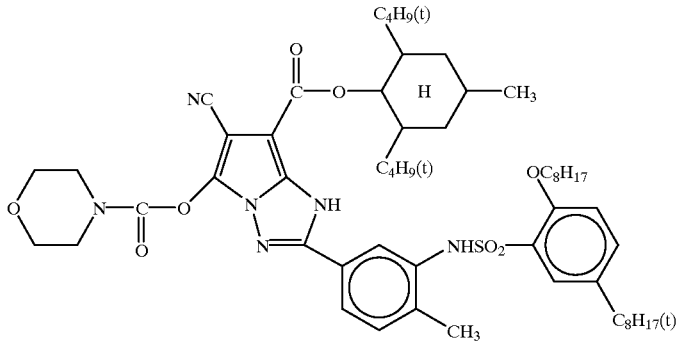
(33)
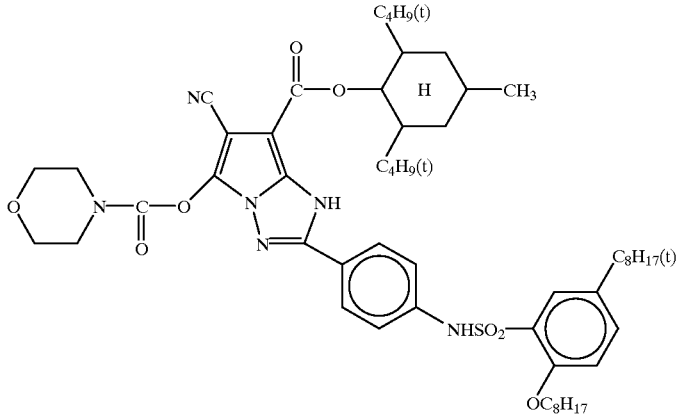
(34)
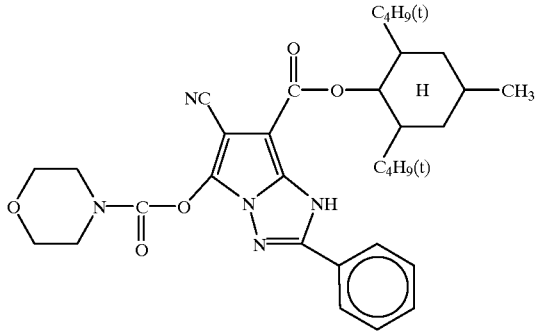
(35)
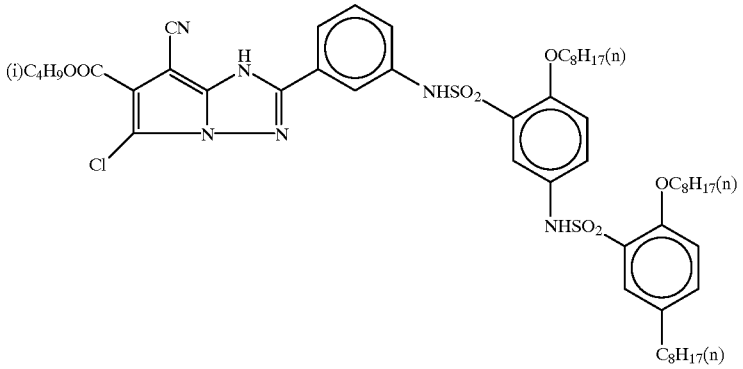

-continued
(36)
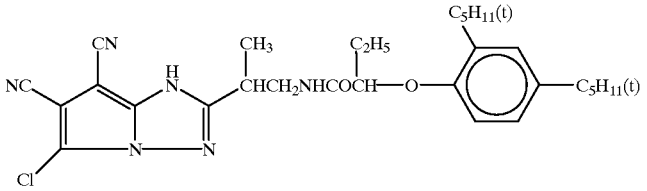
(37)
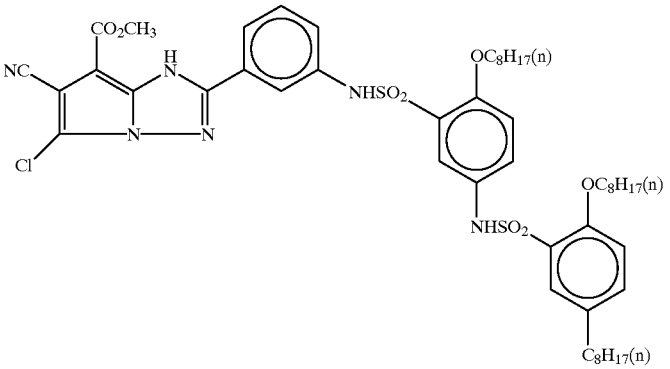
(38)
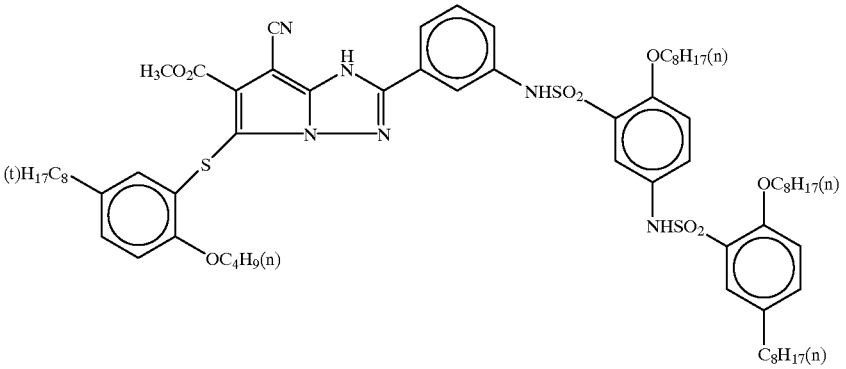
(39)
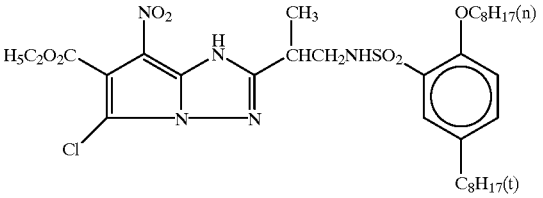
(40)
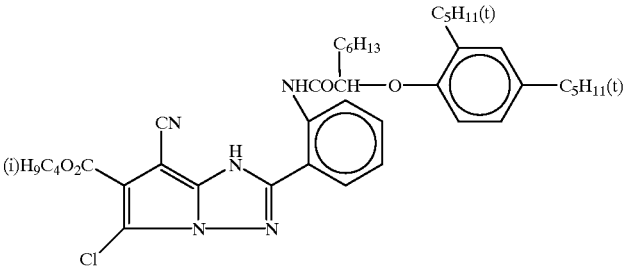

-continued
(41)
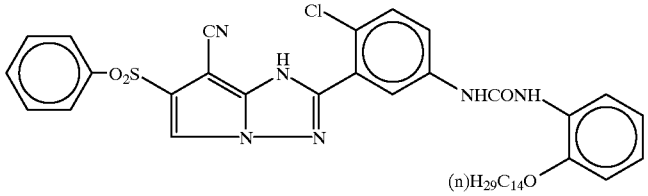
(42)
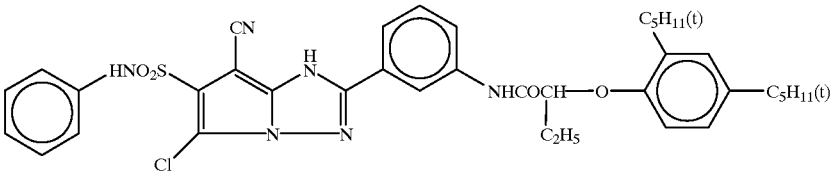
(43)
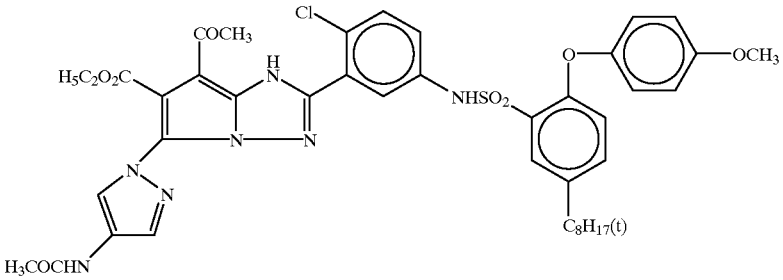
(44)
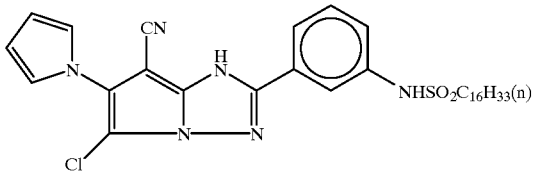
(45)
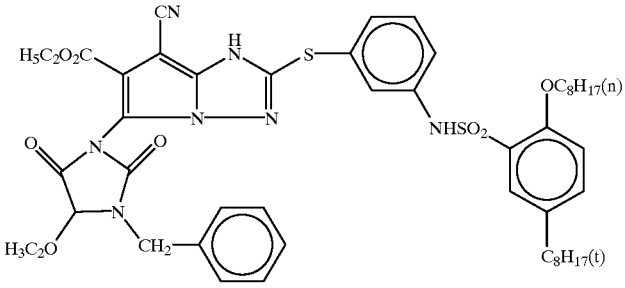
(46)
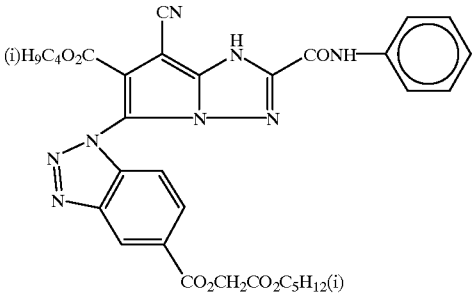

-continued (47)

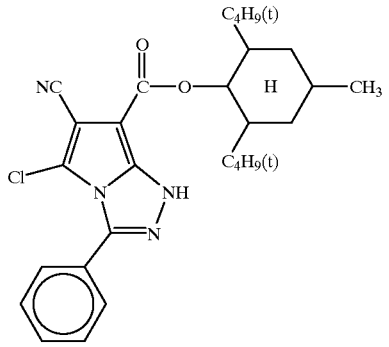

The compound represented by the formula (1) used in the present invention can be synthesized according to conventionally known methods, for example, methods described in JP-A-5-150423, JP-A-5-255333, JP-A-5-202004 and JP-A-7-48376.

Synthesis examples of the compound represented by the formula (1) are specifically set forth below.

SYNTHESIS EXAMPLE 1

Synthesis of Compound (1)

Compound (1) was synthesized along the route shown below.

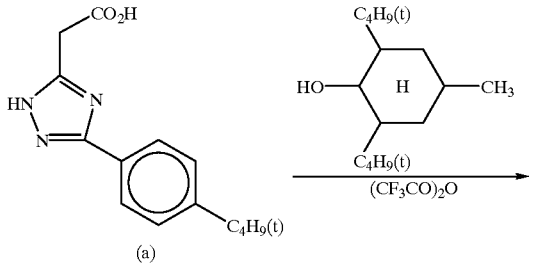

(a)

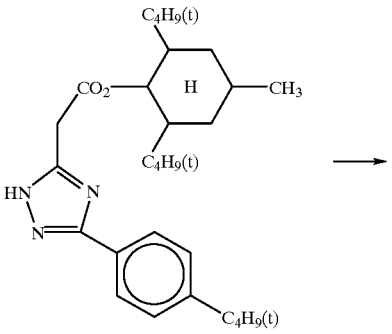

(b)

-continued

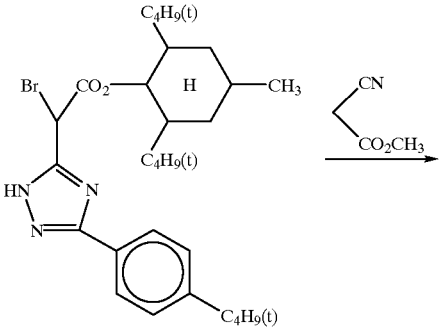

(c)

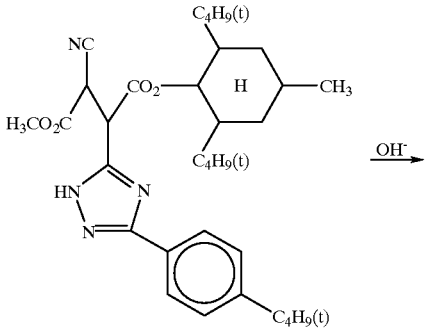

(d)

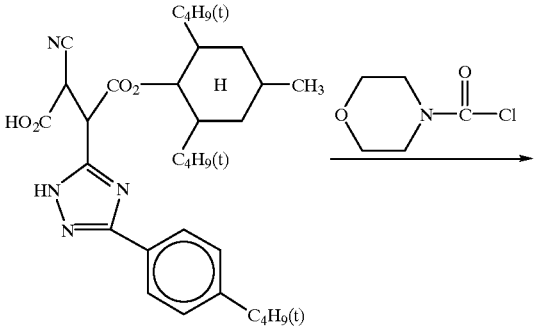

(e)

-continued

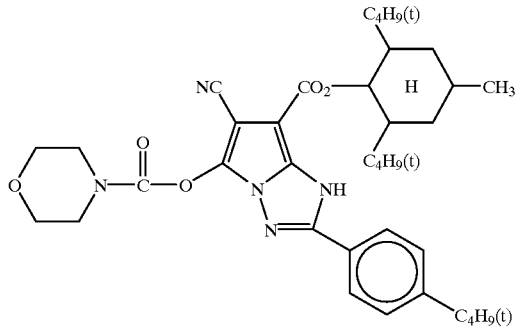

Compound (1)

Synthesis of Compound (b)

To 200 ml of an acetonitrile solution containing 17 g (75 mmol) of 2,6-di-tert-butyl-4-methylcyclohexanol was dropwise added 10.6 ml (75 mmol) of trifluoroacetic anhydride at temperature of 0° C., and then 15.6 g (0.4 mmol) of Compound (a) was gradually added thereto. The reaction solution was stirred at room temperature for 2 hours and extracted by adding 300 ml of water and 300 ml of ethyl acetate. The organic layer was washed with an aqueous sodium bicarbonate solution, water and an aqueous sodium chloride solution in order and dried with magnesium sulfate. The solvent was distilled off under a reduced pressure and the residue was recrystallized from acetonitrile to obtain 19.6 g of Compound (b).

Synthesis of Compound (c)

To 200 ml of ethyl acetate solution containing 19.6 g of Compound (b) was added 5 ml of pyridine, and bromine was dropwise added thereto under cooling with ice. The mixture was stirred for one hour and extracted by adding 300 ml of water and 300 ml of ethyl acetate. The ethyl acetate layer was dried with magnesium sulfate. The solvent was distilled off, and the residue was recrystallized by adding acetonitrile to obtain 18.0 g of Compound (c).

Synthesis of Compound (e)

To 20 ml of dimethylacetamide solution containing 2.2 g of methyl cyanoacetate was gradually added 0.8 g of sodium hydride at temperature of 0° C., and the mixture was stirred at room temperature for 30 minutes to prepare Solution S. 50 ml of dimethylacetamide solution containing 10.0 g of Compound (c) dissolved therein was gradually dropwise added to Solution S under cooling with ice. After stirring for one hour, to the reaction solution were added 20 ml of an aqueous solution containing 4 g of sodium hydroxide and 20 ml of methanol, and the mixture was stirred for one hour while maintaining the reaction temperature at 50° C. Then, 200 ml of ethyl acetate was added thereto, and the mixture was neutralized with aqueous hydrochloric acid and washed with water. The ethyl acetate layer was dried with magnesium sulfate and the solvent as distilled off under a reduced pressure to obtain Compound (e) in the crude form.

Synthesis of Compound (1)

To a solution containing 8.0 g of Compound (e) in the crude form dissolved in 40 ml of dimethylacetamide and 6 ml of pyridine was added 4.3 g of morpholinocarbamoyl chloride at temperature of 0° C. The mixture was stirred for 2 hours at room temperature to conduct reaction and poured into 200 ml of diluted aqueous hydrochloric acid and extracted with 200 ml of ethyl acetate. The organic layer was washed with water and dried with magnesium sulfate. The solvent was distilled off under a reduced pressure and the residue was crystallized by adding hexane to obtain 6.0 g of Compound (1). A melting point of Compound (1) was 256 to 257° C.

SYNTHESIS EXAMPLE 2

Synthesis of Compound (25)

In the step of Synthesis of Compound (1) described above, 4.5 g of diallylcarbamoyl chloride was used in place of 4.3 g of morpholinocarbamoyl chloride. The mixture was stirred for 2 hours at room temperature to conduct reaction and poured into 200 ml of diluted aqueous hydrochloric acid and extracted with 200 ml of ethyl acetate. The organic layer was washed with water and dried with magnesium sulfate. The solvent was distilled off under a reduced pressure and the residue was crystallized by adding hexane to obtain 5.5 g of Compound (25). A melting point of Compound (25) was 219 to 220° C.

Other compounds of the formula (1) are synthesized in an analogous manner.

Now, the compound represented by the formula (A) used in the present invention will be described in more detail below.

In the formula (1), $R^a$ and $R^b$ each individually represents a substituted or unsubstituted aryl group or a substituted or unsubstituted alkyl group having from 2 to 30 carbon atoms in total including the substituent(s).

An unsubstituted aryl group is preferred than a substituted aryl group for $R^a$ or $R^b$.

When $R^a$ or $R^b$ represents the substituted aryl group, the substituent for the aryl group is the same as that defined for $R^3$ in the formula (1) and specific examples thereof include those described for $R^3$.

Preferable examples of the substituent include an alkyl group, an alkoxy group, an acylamino group, a halogen atom, an aminocarbonylamino group and an alkoxycarbonylamino group. An alkyl group having from 1 to 10 carbon atoms, a halogen atom (e.g., chlorine or bromine) or an alkoxy group having from 1 to 10 carbon atoms is more preferred for the substituent.

When $R^a$ or $R^b$ represents the alkyl group, the total number of carbon atoms including the substituent(s) is from 2 to 30. An unsubstituted alkyl group may be a straight chain or branched chain alkyl group. The straight chain alkyl group preferably has from 2 to 26 carbon atoms (e.g., ethyl, n-propyl, n-butyl, n-hexyl, n-octyl, n-decyl, n-octadecyl, or n-eicosyl), and the branched chain alkyl group preferably has from 2 to 26 carbon atoms (e.g., isopropyl, tert-butyl, or 2-ethylhexyl).

When $R^a$ or $R^b$ represents the substituted alkyl group, the substituent for the alkyl group is the same as that defined for $R^3$ in the formula (1) and the total number of carbon atoms including the substituent(s) is preferably from 2 to 20. Specific examples of the substituent for the alkyl group include those described for $R^3$. Specific examples of the substituted alkyl group include ethoxymethyl, acetoxymethyl, stearoyloxymethyl, p-phenoxymethyl, 1-nitrophenoxymethyl, and 1-chlorooctyl.

In the formula (A), $R^4$ and $R^5$ each represents a hydrogen atom, a substituted or unsubstituted alkyl group or a substituted or unsubstituted aryl group.

When $R^4$ or $R^5$ represents the substituted alkyl group or the substituted aryl group, the substituents for the alkyl group and aryl group are the same as those defined for $R^3$ in the formula (1), respectively, and specific examples thereof include those described for $R^3$, respectively.

The alkyl group represented by $R^4$ or $R^5$ preferably has from 1 to 20 carbon atoms. An unsubstituted alkyl group is preferred than a substituted alkyl group for $R^4$ or $R^5$.

The aryl group represented by $R^4$ or $R^5$ preferably has from 6 to 20 carbon atoms.

It is preferred that at least one of $R^4$ or $R^5$ represents a hydrogen atom.

In the formula (A), $R^6$ represents a substituted or unsubstituted aryl group. When $R^6$ represents the substituted aryl group, the substituent for the aryl group is the same as that defined for $R^3$ in the formula (1) and specific examples thereof include those described for $R^3$.

Preferable examples of the substituent include an alkyl group having from 1 to 20 carbon atoms (e.g., methyl, ethyl, isopropyl, tert-butyl, or n-octyl), an alkoxy group having from 1 to 20 carbon atoms (e.g., methoxy, ethoxy, isopropoxy, tert-butoxy, n-octyloxy, n-tetradecyloxy, n-hexadecyloxy, or n-octadecyloxy), an acylamino group having from 1 to 20 carbon atoms (e.g., acetylamino; propiponylamino, or stearoylamino), an alkoxycarbonylamino group having from 2 to 20 carbon atoms (e.g., methoxycarbonylamino, ethoxycarbonylamino, or octyloxycarbonylamino), an aminocarbonylamino group having from 1 to 20 carbon atoms (e.g., dimethylaminocarbonylamino, or dioctylaminocarbonylamino), an alkylsulfonylamino group having from 1 to 20 carbon atoms (e.g., methanesulfonylamino, ethanesulfonylamino, butanesulfonylamino, or octanesulfonylamino), and an arylsulfonylamino group having from 6 to 20 carbon atoms (e.g., benzenesulfonylamino, toluenesulfonylamino, or dodecylbenzenesulfonylamino).

The compound represented by the formula (A) is preferably has a so-called ballast group in at least one of $R^a$, $R^b$, $R^4$, $R^5$ and $R^6$ in view of diffusion resistivity. The molecular weight of the compound is preferably 200 or more, more preferably 250 or more, further more preferably 300 or more, and most preferably 350 or more.

Of the phenidone compounds represented by the formula (A) according to the present invention, those wherein either $R^a$ or $R^b$ is a hydrogen atom are preferred, and those wherein $R^a$ is a hydrogen atom, $R^b$ is an alkyl group (more preferably an unsubstituted alkyl group having 12 to 24 carbon atoms) both $R^4$ and $R^5$ are hydrogen atoms, and $R^6$ is an aryl group are more preferred. Among them, those wherein $R^6$ is an unsubstituted aryl group, or an aryl group substituted with an alkoxy group, an acylamino group, an alkylsulfonylamino group or an arylsulfonylamino group are further more preferred.

Specific examples of the compound represented by the formula (A) which can be used in the present invention are set forth below, but the present invention should not be construed as being limited thereto.

1.

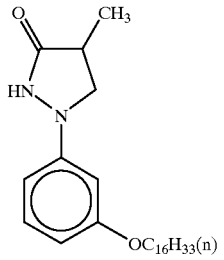

-continued

2.

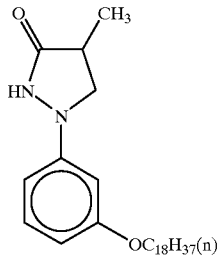

3.

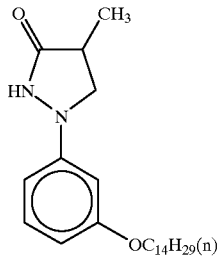

4.

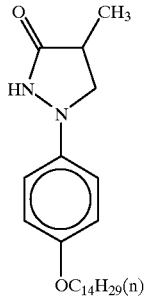

5.

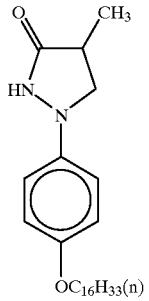

6.

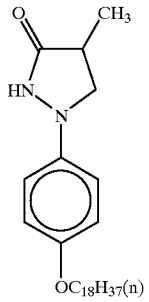

-continued
7.
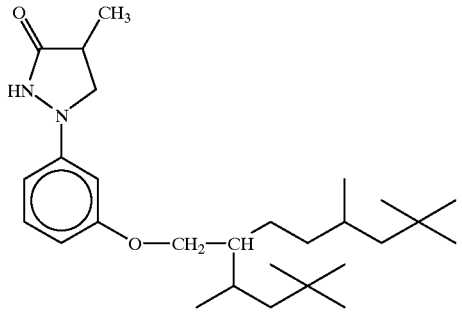
8.
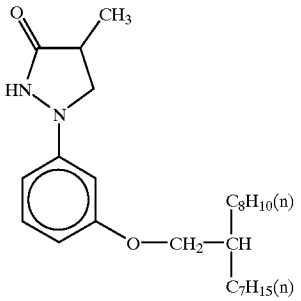
9.
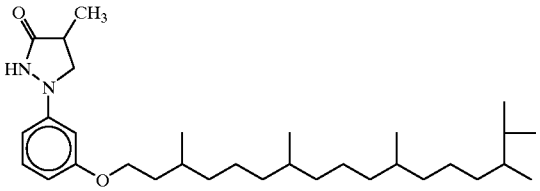
10.
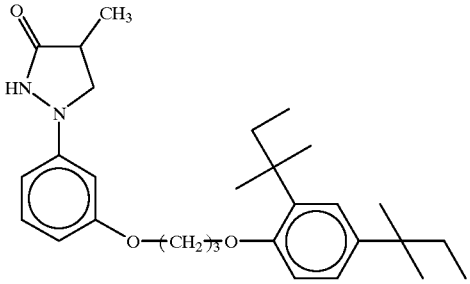
11.
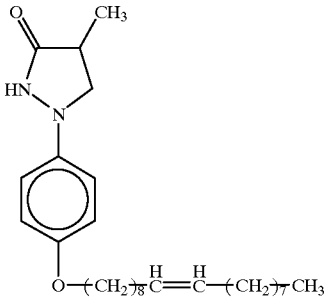
-continued
12.
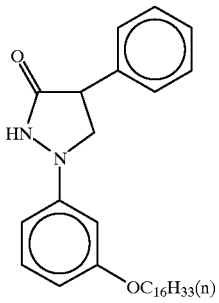
13.
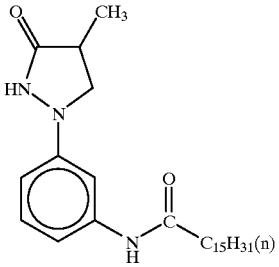
14.
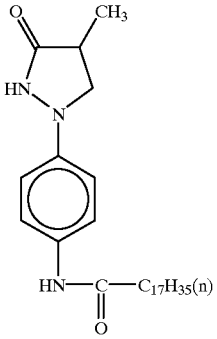
15.
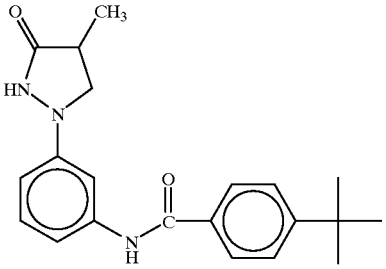
16.
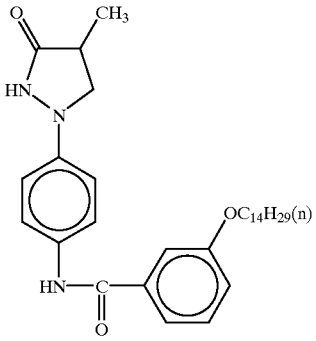

-continued
17.
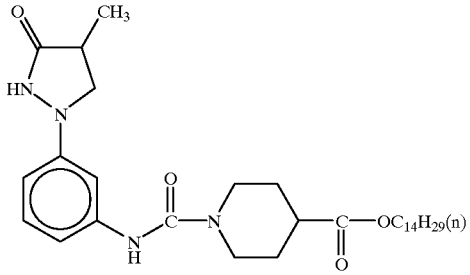
18.
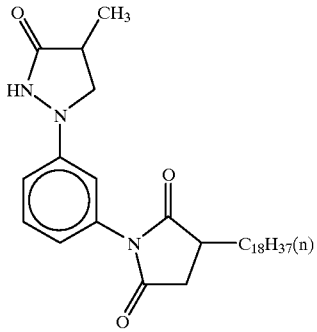
19.
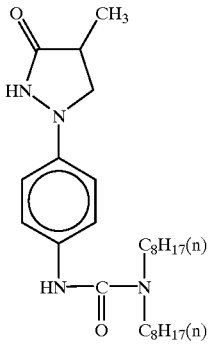
20.
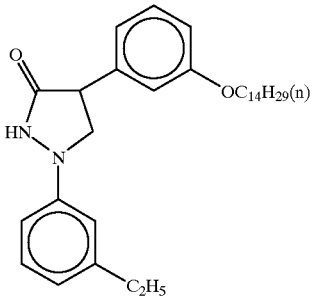
21.
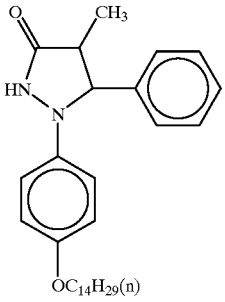
-continued
22.
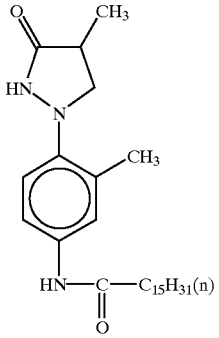
23.
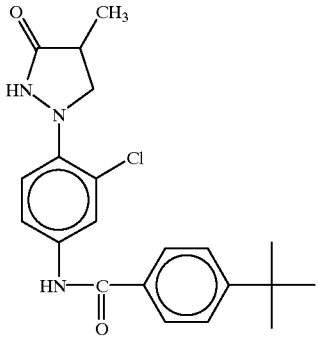
24.
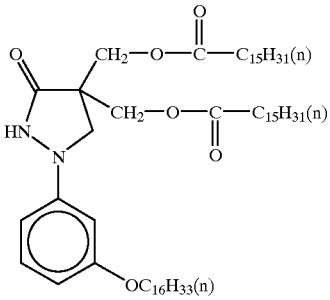
25.
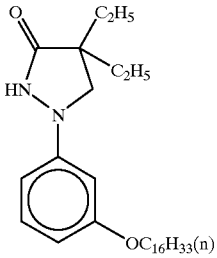

-continued
26.
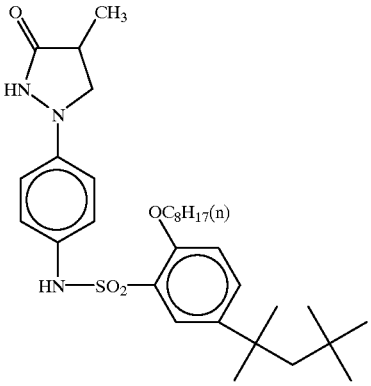
27.
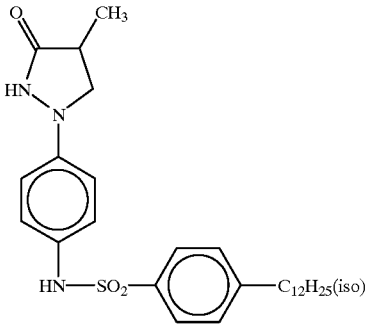
28.
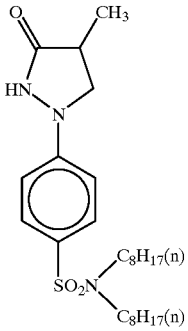
29.
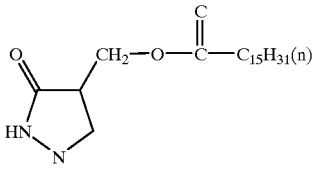
30.
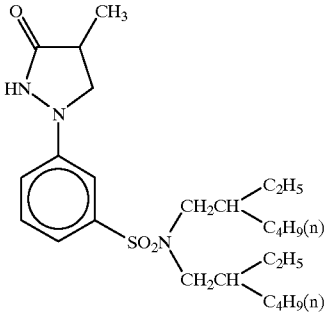
-continued
31.
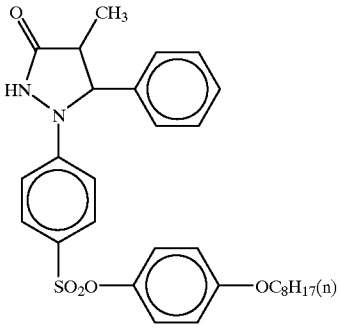
32.
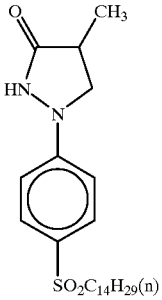
33.
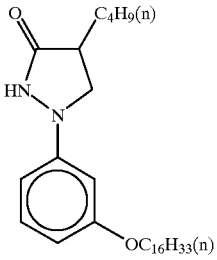
34.
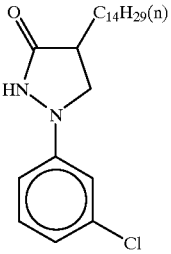
35.
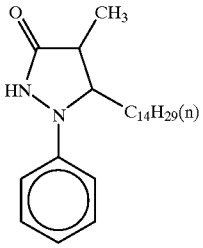

-continued
36.
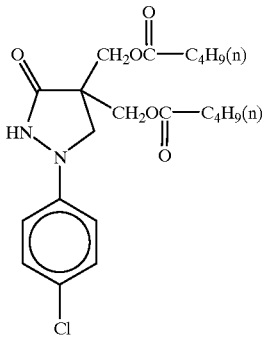
37.
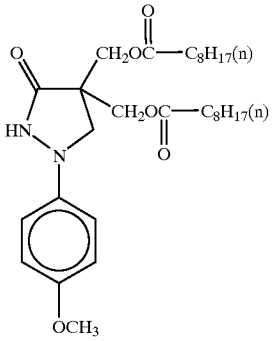
38.
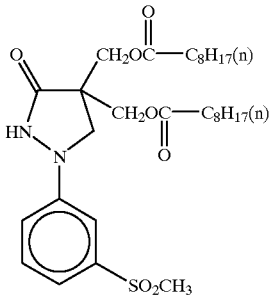
39.
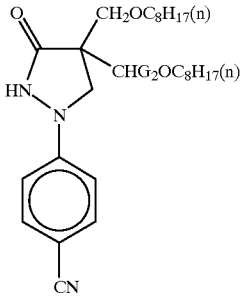
40.
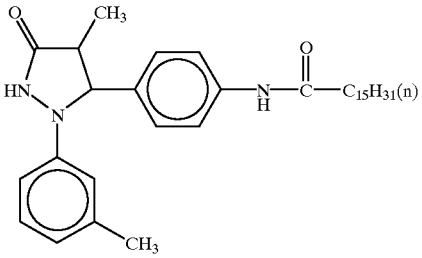
-continued
41.
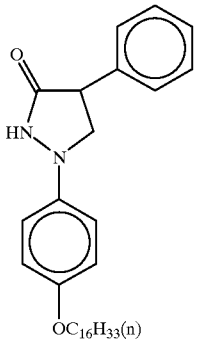
42.
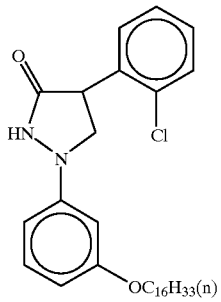
43.
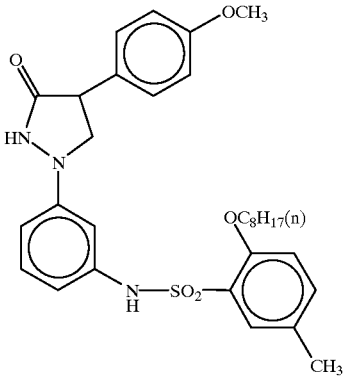
44.
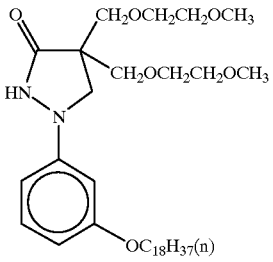
45.
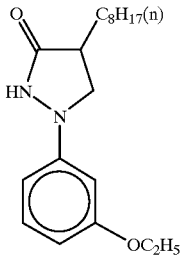

-continued
46.
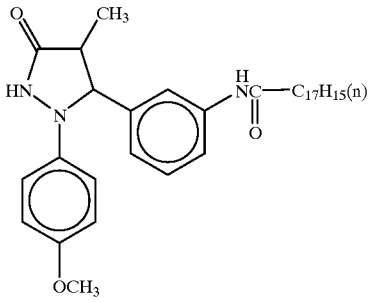
47.
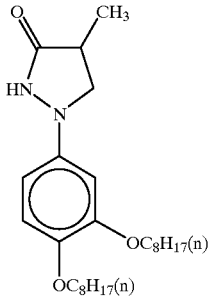
48.
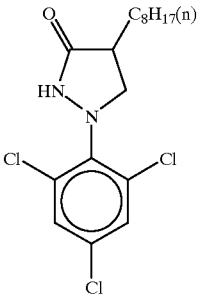
49.
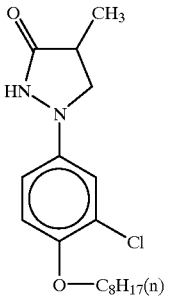
50.
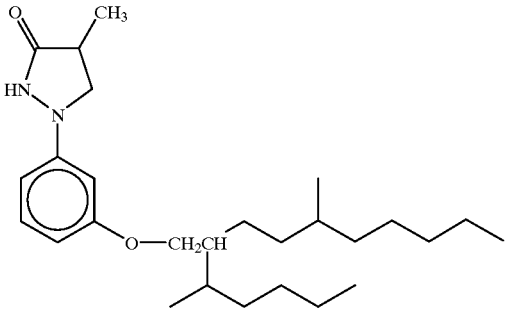
-continued
51.
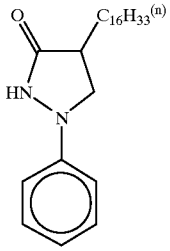
52.
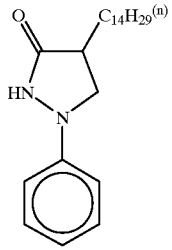
53.
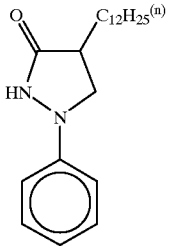
54.
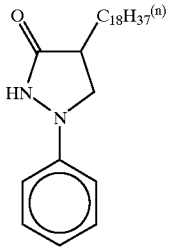
55.
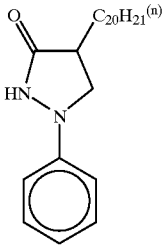
56.
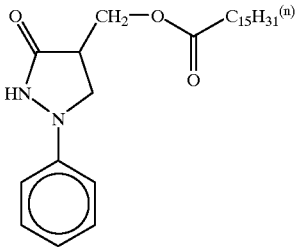

-continued
57.
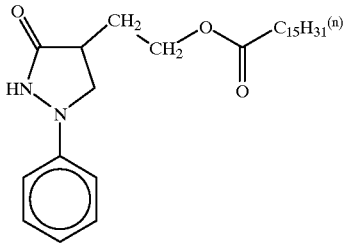
58.
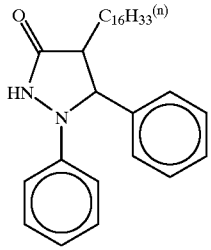
59.
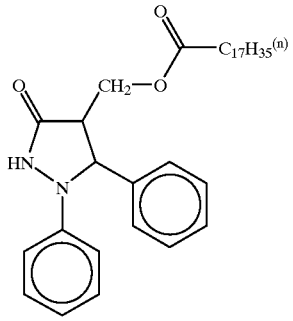
60.
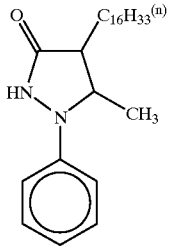
61.
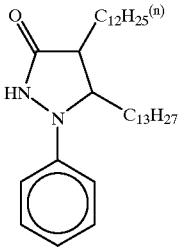
-continued
62.
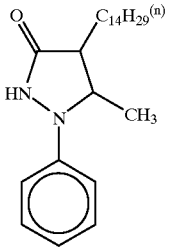
63.
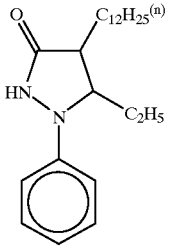
64.
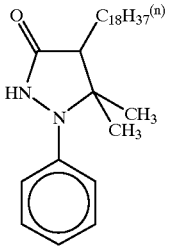
65.
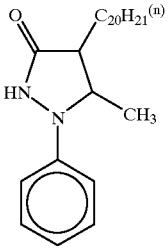
66.
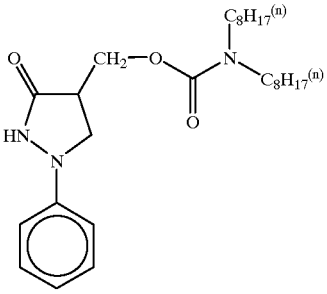

-continued

67.

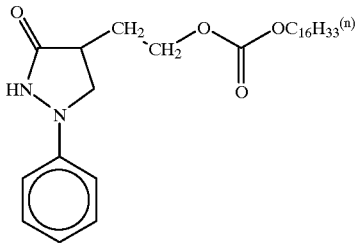

68.

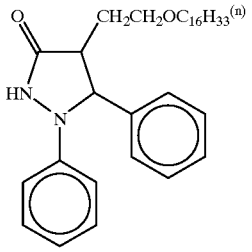

69.

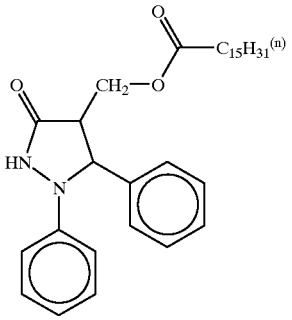

70.

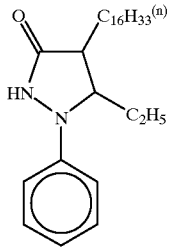

The compound represented by the formula (A) used in the present invention can be synthesized by a ring closing reaction of a compound (A)-A with a hydrazine according to the method shown below.

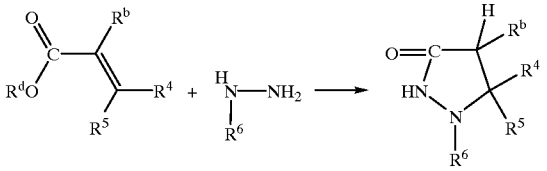

Compound (A)-A Hydrazine wherein $R^d$ represents an alkyl group or an aryl group, and $R^b$, $R^4$, $R^5$ and $R^6$ each has the same meaning as defined in the formula (A).

The reaction is preferably conducted using at least one equivalent of a base in an appropriate solvent. When a hydrazine salt is employed, it is preferred to use two or more equivalents of base in order to liberate a hydrazine. As the base, an alkoxide is preferably used. Specific examples thereof include potassium tert-butoxide and sodium methoxide. Suitable examples of the solvent include n-butanol, tert-butanol, dimethylsulfoxide and dimethylacetamide.

The reaction can be ordinarily performed at temperature of from −20° C. to 180° C., preferably from 0° C. to 120° C., and more preferably from 30° C. to 90° C.

The reaction time is ordinarily from 5 minutes to 24 hours, preferably from 30 minutes to 6 hours, and more preferably from one hour to 3 hours.

A ratio of the hydrazine and the compound (A)-A used preferably from 2:1 to 1:2 by mole, and more preferably from 1.2:1 to 1:1.2 by mole.

Synthesis examples of the compound (A) are specifically set force below.

SYNTHESIS EXAMPLE 1

Synthesis of Compound 1

Compound 1 was synthesized along the route shown below.

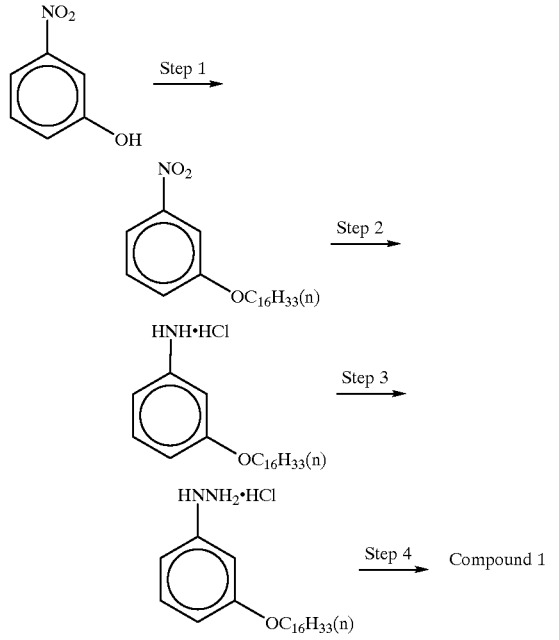

Step 1

A mixture of 145 g of m-nitrophenol, 300 g of 1-chlorohexadecane, 750 ml of dimethylacetamide and 158 g of potassium carbonate was reacted at 115° C. for 2 hours. After cooling to 50° C., to the reaction mixture was added 750 ml of acetonitrile, and 200 ml of water was dropwise added thereto. The crystals thus-deposited were collected by filtration, washed thoroughly with methanol and dried to quantitatively obtain 358 g of m-hexadecyloxynitrobenzene.

Step 2

A mixture of 226 g of reduced iron, 18.05 g of ammonium chloride, 250 g of water and 2.5 liters of isopropyl alcohol was refluxed, and 250 g of m-hexadecyloxynitrobenzene was added thereto. After reacting for 30 minutes, the reaction mixture was subjected to filtration using Sellaite as a filter medium to remove the reduced iron. To the filtrate was added 58 ml of concentrated hydrochloric acid, followed by cooling. The crystals thus-deposited were collected by filtration, washed thoroughly with methanol and dried to obtain 211.8 g (yield: 82.9%) of m-hexadecyloxyaminobenzene hydrochloride.

Step 3

To a mixture of 210 g of m-hexadecyloxyaminobenzene hydrochloride and 1.4 liters of acetic acid was added dropwise 80 ml of concentrated hydrochloric acid at 20° C. under stirring. After stirring for 5 minutes, 85.3 g of isoamyl nitrite thereto. The reaction was conducted for 30 minutes and a solution of 201 g of tin(II) chloride in 245 ml of concentrated hydrochloric acid was added dropwise thereto at 10° C. After reacting at 20° C. for one hour, 1.4 liters of methanol was added thereto, followed by allowing to crystalize at 10° C. The resulting crystals were collected by filtration and washed thoroughly with methanol to obtain crude crystals. The crude crystals were recrystallized from 800 ml of methanol to obtain 130.2 g (yield: 59.6%) of m-hexadecyloxyphenyl-hydrazine hydrochloride.

Step 4

To a mixture of 125 g of m-hexadecyloxyphenylhydrazine hydrochloride, 1.5 g of 4-tert-butylcatechol and 625 ml of dimethylsulfoxide was added 83.5 g of potassium tert-butoxide while stirring. After stirring for 10 minutes, 40.8 g of ethyl methacrylate was added thereto, followed by reacting at 45° C. for 30 minutes. Concentrated hydrochloric acid was added to the reaction mixture to acidify the pH thereof. The crystals thus-deposited were collected by filtration and washed with methanol to obtain crude crystals. The crude crystals were recrystallized from 300 ml of methanol to obtain 81.2 g (yield: 60.1%) of Compound 1. The structure of Compound 1 were confirmed by NMR and mass spectra.

SYNTHESIS EXAMPLE 2

Synthesis of Compound 51

Compound 51 was synthesized along the route shown below.

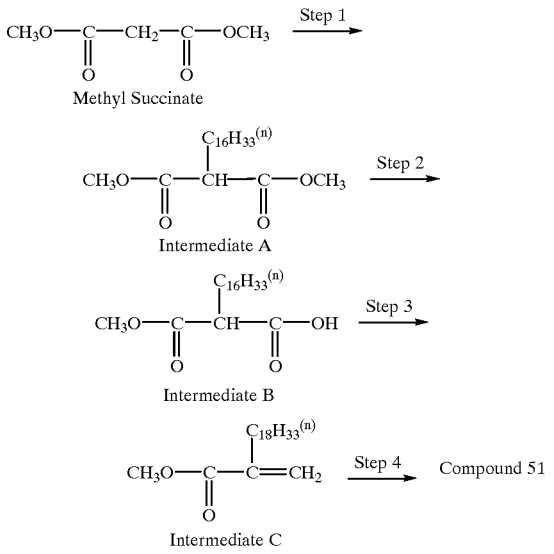

Step 1

A mixture of 256 g (1.94 mol) of methyl succinate and 800 ml of methanol was stirred at room temperature and was added dropwise thereto 375 g (1.94 mol) of sodium methylate (28% by weight). Then, 592 g (1.94 mol) of 1-bromohexadecane was added dropwise thereto. After refluxing for 3 hours, the methanol was distilled off, and the residue was poured into 1 N hydrochloric acid. The mixture was extracted with hexane, and the extract was washed with an aqueous sodium chloride solution and dried. The solvent was distilled off to obtain 511 g (1.43 mol, yield: 73.7%) of Intermediate A.

Step 2

To a mixture of 511 g (1.43 mol) of Intermediate A and 800 ml of methanol was added dropwise a solution containing 94.6 g (1.43 mol) of potassium hydroxide (85%) dissolved in 800 ml of methanol at 35° C. with stirring. After reacting at 40° C. for 2 hours, a solution containing 130 ml of concentrated hydrochloric acid dissolved in 500 ml of water was added dropwise. The crystals thus-deposited were collected by filtration, washed with water and n-hexane to obtain Intermediate B which was used in the next step without drying.

Step 3

To a mixture of the whole amount (1.43 mol) of Intermediate B and 1.0 liter of methanol was added dropwise 115 g (1.57 mol) of diethylamine at 20° C. with stirring. Then, 135 g (1.57 mol) of a 35% aqueous formaldehyde solution was added dropwise thereto, followed by reacting at 20° C. for 24 hours. The crystals thus-deposited were collected by filtration, washed with water and methanol and dried to obtain 396 g (1.28 mol, yield: 89.5%) of Intermediate C.

Step 4

A mixture of 1.45 g (1.34 mol) of phenylhydrazine and 1.5 liters of toluene was stirred at 140° C. and the solvent was distilled off using a Dean-Stark dehydrator until the inner temperature became 100° C. Then, 272 g (1.41 mol) of sodium methylate (28% by weight) was added dropwise thereto and methanol was distilled off. A solution containing 396 g (1.28 mol) of Intermediate C in 400 ml of toluene was added dropwise thereto.

After refluxing for 30 minutes, the reaction mixture was cooled with ice, and were added 150 ml of concentrated hydrochloric acid and then 200 ml of ethyl acetate thereto. The insoluble substance was removed by filtration and the filtrate was cooled. The crystals thus-deposited were collected by filtration, washed with water and n-hexane and dried to obtain 393 g (1.02 mol, yield: 79.7%) of Compound 51.

Other compounds of the formula (A) are synthesized in an analogous manner with reference to the synthesis methods described above.

Now, the compound having a diffusion-resistant group represented by the formula (D) which can be used in the present invention will be described in more detail below.

The diffusion-resistant group is a hydrophobic substituent which is provided to an organic substance for the purpose of fixing the organic substance in a desired layer. Owing to the presence of the diffusion-resistant group, the compound of the formula (D) used in the present invention is decreased its water solubility to 2% or less, preferably 1% or less, and can stay in dispersed oil droplets of a high boiling point organic solvent. The diffusion-resistant group used ordinarily includes a substituted or unsubstituted alkyl group and a substituted or unsubstituted aryl group each having a certain size. In the compound according to the present invention, it is necessary to impart sufficient diffusion resistivity thereto since the carbonamido group contained is a hydrophilic group. Therefore, although the diffusion-resistant group used in the compound according to the present invention may be varied depending on the presence of other hydrophilic group and the hydrophilicity thereof, it is preferably an alkyl group or an aryl group each having the total number of carbon atoms including substituent(s) of from 8 to 32. Taking a solubility of the compound to a high boiling point organic solvent into consideration, the diffusion-resistant group is more preferably an alkyl group or an aryl group each having the total number of carbon atoms including substituent(s) of from 12 to 22. A straight chain or branched chain alkyl group having from 12 to 20 carbon atoms is particularly preferred when the productivity is additionally considered. A number of the diffusion-resistant group present in the compound is preferably from 1 to 4, more preferably 1 or 2, and particularly preferably 1.

Specific examples of the diffusion-resistant group include an alkyl group (for example, n-octyl, n-decyl, n-dodecyl, n-tetradecyl, n-hexadecyl, n-octadecyl, chlohexyl, cyclopentyl, 2-ethylhexyl, 2-n-hexyl-n-decyl, 2-n-nonyl-n-dodecyl, isomyristyl, isopalmityl, or isostearyl), an acyl group, an acylamino group, an alkoxy group, an alkoxycarbonyl group, a carbamoyl group, an alkoxycarbonylamino group, a carbamoylamino group, a sulfenyl group, a sulfinyl group, a sulfonyl group, a sulfamoyl group, a sulfonylamino group and a sulfamoylamino group each having the alkyl moiety as above, an aryl group (for example, 2,5-di-tert-amylphenyl, 2,5-di-tert-butylphenyl, 4-tert-octylphenyl, or 3-n-pentadecyl-phenyl), an acyl group, an acylamino group, an aryloxy group, an aryloxycarbonyl group, a carbamoyl group, an aryloxycarbonylamino group, a carbamoylamino group, a sulfenyl group, a sulfinyl group, a sulfonyl group, a sulfamoyl group, a sulfonylamino group and a sulfamoylamino group each having the aryl moiety as above.

The compound represented by the formula (D) is preferably a non-color forming colorless compound. The term "non-color forming" used herein with respect to the compound of the formula (D) means that the compound does not cause a coupling reaction with an oxidation product of a color developing agent upon color development for forming a dye. The term "colorless" used herein with respect to the compound of the formula (D) means that the compound is substantially colorless before and after the incorporation thereof into a photographic light- sensitive material. Therefore, the non-color forming colorless compound of the formula (D) having a diffusion-resistant group according to the present invention does not include a dye forming coupler, a coloring matter and a dye.

The halogen atom represented by $R^{53}$ in the formula (D) is preferably a fluorine atom, a chlorine atom or a bromine atom, more preferably a fluorine atom or a chlorine atom, and particularly preferably a chlorine atom.

The substituted or unsubstituted alkyl group represented by $R^{51}$, $R^{51}$ or $R^{53}$ in the formula (D) is preferably a straight chain, branched chain or cyclic alkyl group having from 1 to 30 carbon atoms, more preferably a straight chain or branched chain alkyl group having from 1 to 22 carbon atoms, and particularly preferably a straight chain alkyl group having from 1 to 20 carbon atoms.

The substituted or unsubstituted aryl group represented by $R^{51}$, $R^{52}$ or $R^{53}$ in the formula (D) is preferably an aryl group having from 6 to 20 carbon atoms, more preferably an aryl group having from 6 to 14 carbon atoms, and particularly preferably an aryl group having from 6 to 10 carbon atoms.

The substituted or unsubstituted acyl group represented by $R^{51}$, $R^{52}$ or $R^{53}$ in the formula (D) is preferably an acyl group represented by the formula of —$COR^{61}$, wherein $R^{61}$ represents a hydrogen atom, a substituted or unsubstituted alkyl group or a substituted or unsubstituted aryl group.

The substituted or unsubstituted carbamoyl group represented by $R^{51}$, $R^{52}$ or $R^{53}$ in the formula (D) is preferably a carbamoyl group represented by the formula of —$CONR^{62}R^{63}$, wherein $R^{62}$ and $R^{63}$ each represents a hydrogen atom, a substituted or unsubstituted alkyl group or a substituted or unsubstituted aryl group.

The substituted or unsubstituted alkoxycarbonyl group represented by $R^{51}$, $R^{52}$ and $R^{53}$ in the formula (D) is preferably an alkoxycarbonyl group represented by the formula of —$CO_2R^{64}$, wherein $R^{64}$ represents a hydrogen atom, a substituted or unsubstituted alkyl group or a substituted or unsubstituted aryl group.

The substituted or unsubstituted sulfonyl group represented by $R^{53}$ in the formula (D) is preferably a sulfonyl group represented by the formula of —$SO_2R^{65}$, wherein $R^{65}$ represents a hydrogen atom, a substituted or unsubstituted alkyl group or a substituted or unsubstituted aryl group.

The substituted or unsubstituted sulfamoyl group represented by $R^{53}$ in the formula (D) is preferably a sulfamyl group represented by the formula of —$SO_2NR^{66}R^{67}$, wherein $R^{64}$ and $R^{67}$ each represents a hydrogen atom, a substituted or unsubstituted alkyl group or a substituted or unsubstituted aryl group.

In the formula (D), $R^{51}$ and $R^{52}$ each is preferably a substituted or unsubstituted alkyl group or a substituted or unsubstituted acyl group, and more preferably a substituted or unsubstituted alkyl group.

In the formula (D), $R^{53}$ is preferably a halogen atom, a substituted or unsubstituted alkyl group, a substituted or unsubstituted acyl group, a substituted or unsubstituted carbamoyl group or a substituted or unsubstituted alkoxycarbonyl group, and more preferably a halogen atom or an unsubstituted alkyl group.

In the formula (D), q is preferably an integer of 0 or 1, more preferably 0; and r is preferably an integer of from 0 to 3, more preferably an integer of from 0 to 2, and particularly an integer of 0 or 1.

In the formula (D), when q is an integer of two or more, plural (O—$R^{52}$)s may be the same or different; and when r is an integer of two or more, plural $R^{53}$s may be the same or different.

In the formula (D), preferred is the case where $R^{51}$ is a substituted or unsubstituted alkyl group having the total number of the carbon atoms of 8 to 30 or a substituted or unsubstituted acyl group having the total number of the carbon atoms of 8 to 30, q is 0, r is 0 or 1, and $R^{53}$ is a halogen atom. Most preferred is the case where $R^{51}$ is a straight-chain unsubstituted alkyl group having 8 to 20 carbon atoms, q is 0 and r is 0.

Specific examples of the carbonamide compound having a diffusion-resistant group represented by the formula (D) which can be used in the present invention are set forth below, but the present invention should not be construed as being limited thereto.

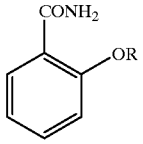
| D | R | D | R |
|---|---|---|---|
| D-1 | C8H17(i) | | |
| | | D-10 | 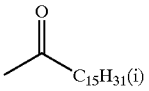  |
| D-2 | C8H17(n) | | |
| | | D-11 | 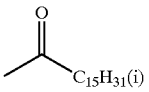  |
| D-3 | C10H22(n) | | |
| D-4 | C12H25(n) | | |
| D-5 | C16H33(n) | D-12 | 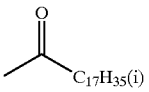  |
| D-6 | C18H37(n) | D-13 | 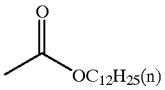  |
| D-7 | C18H35 | D-14 | 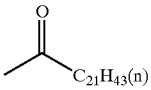  |
| D-8 | 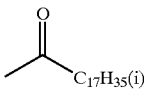  | D-15 | 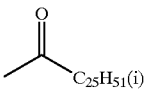  |
| D-9 | 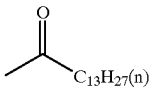  | | |
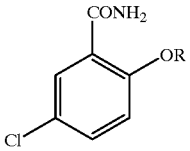
| D | R |
|---|---|
| D-16 | C8H17(n) |
| D-17 | C16H33(n) |
| D-18 | C18H37(n) |
| D-19 | C18H35 |
| D-20 | 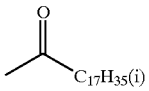  |

-continued
D-21
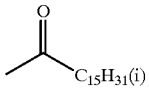
D-23
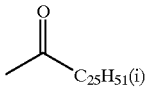
D-24
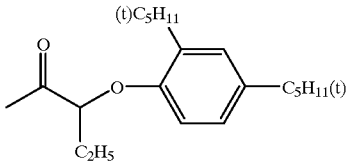
D-25
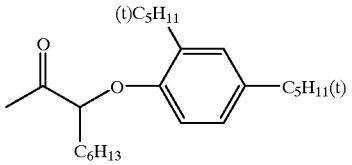
D-25
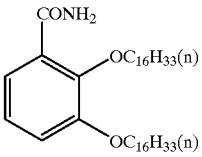
D-26
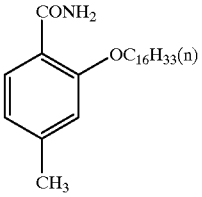
D-27
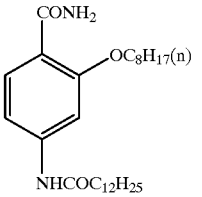
D-31
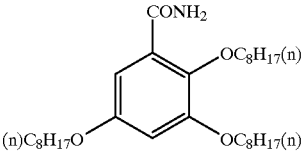
D-32
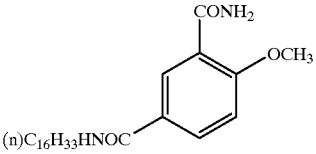
D-28
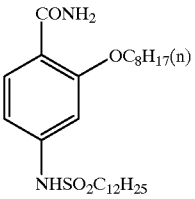
D-29
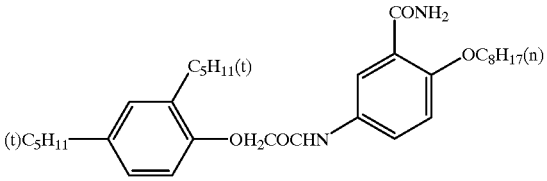
D-30
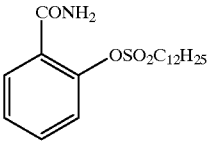
D-34
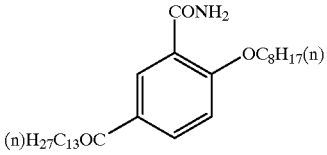
D-35
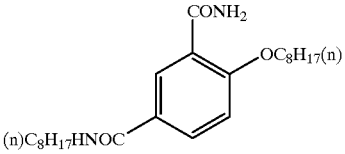

-continued

| | | | |
|---|---|---|---|
| D-33 | 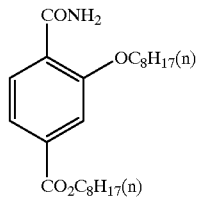 | D-36 | 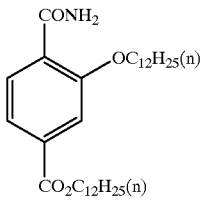 |

Synthesis examples of the carbonamide compound having a diffusion-resistant group represented by the formula (D) which can be used in the present invention are specifically set forth below.

SYNTHESIS EXAMPLE 1

Synthesis of Compound (D-5)

In 600 ml of N,N-dimethylacetamide were dispersed 218.2 g of salicylamide, 511 g of 1-bromohexadecane and 263 g of anhydrous potassium carbonate and the dispersion-was stirred at 85° C. for 2 hours. The reaction mixture was poured into 2 liter of water containing 382 ml of 36% hydrochloric acid, followed by stirring for 3 hours. The crystals thus-deposited were collect by filtration and washed thoroughly with warm water and acetonitrile to obtain 560 g of Compound (D-5). A melting point of Compound (D-5) was 87 to 88° C.

Synthesis of Compound (D-8)

In 100 ml of N,N-dimethylacetamide and 24 g of pyridine were dissolved 20 g of salicylamide and 46 g of isoatearyl chloride and the solution was reacted for 14 hours. The reaction mixture was poured into water and extracted with ethyl acetate. The organic layer was washed with water, separated and the solvent was distilled off under a reduced pressure. The residue was purified by column chromatography to obtain 21 g of Compound (D-8).

Other compounds of the formula (D) are synthesized in an analogous manner with reference to the synthesis methods described above.

The phenidone compound represented by the formula (A) is ordinarily employed in an amount of from 0.1 to 300 mol %, preferably from 5 to 100 mol % and more preferably from 10 to 30 mol % based on the cyan dye forming coupler used.

In the silver halide emulsion layer containing the cyan dye forming coupler represented by the formula (1), an amount of silver to the cyan coupler can be varied appropriately. In view of good color forming property and color reproducibility, a ratio of silver to coupler is preferably from 2.0 to 8.0, more preferably from 2.8 to 6.0, and particularly preferably from 2.8 to 5.0. The ratio of silver to coupler used herein means a molar ratio of the amount of silver to the amount of coupler used.

The cyan dye forming coupler represented by the formula (1) is provided on a support ordinarily in an amount of from 0.01 to 1 g/m$^2$, preferably from 0.05 to 0.4 g/m$^2$, and more preferably from 0.1 to 0.3 g/m$^2$. The amount of coupler is suitably from $1\times10^{-3}$ to 1 mol, preferably $2\times10^{-3}$ to $3\times10^{-1}$ mol, per mol of silver halide present in the same layer.

The amount of the carbonamide compound represented by the formula (D) to be used is preferably from 0.0002 g to 20 g, more preferably from 0.001 g to 5 g, per m$^2$ of the photographic light-sensitive material, and it is preferably in a range of from 0.1 to 8 parts by weight, more preferably in a range of from 0.1 to 4 parts by weight, per 1 part by weight of the cyan dye forming coupler represented by the formula (1).

In order to incorporate the cyan dye forming coupler, the compound b the formula (A) and the compound of the formula (D) according to the present invention into a silver halide photographic light-sensitive material, known dispersion methods, for example, an oil-droplet-in-water dispersion method using a high-boiling point organic solvent, a latex dispersion method or a polymer dispersion method comprising emulsification together with an oil-soluble polymer as described, for example, in *Research Disclosure*, February 1995, Item 37038 can be employed.

In the oil-droplet-in-water dispersion method using a high-boiling point organic solvent, an amount of the high-boiling point organic solvent is appropriately selected. A weight ratio of the high-boiling point organic solvent to the total cyan coupler used is preferably from 0.1 to 8.0, more preferably from 0.3 to 6.0, and particularly preferably from 0.5 to 4.0. It is also possible that the high-boiling point organic solvent is not used.

The carbonamide compound represented by the formula (D) according to the present invention can be employed together with a conventionally known high boiling point organic solvent. When the known high boiling point organic solvent is used together, the amount of the carbonamide compound according to the present invention is preferably from 10 to 200% by weight, more preferably 20 to 150% by weight, based on the total amount of the high boiling point organic solvent. The known high boiling point organic solvent which is preferably used together with the carbonamide compound according to the present invention has suitably a dielectric constant of from 2.0 to 7.0, and preferably from 3.0 to 6.0.

Examples of the high boiling point solvent used together with the carbonamide compound according to the present invention are described, for example, in U.S. Pat. No. 2,322,027.

Specific examples of the high boiling point organic solvent having a boiling point of not less than 175° C. at a normal pressure include phthalic acid esters (for example, dibutyl phthalate, dicyclohexyl phthalate, di-2-ethylhexyl phthalate, didecyl phthalate, bis(2,4-di-tert-amylphenyl) phthalate, bis(2,4-di-tert-amylphenyl) isophthalate, or bis(1,1-diethylpropyl) phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, tri-chloropropyl phosphate, or di-2-ethylhexyl phenyl phosphonate), benzoic acid esters (for example, 2-ethylhexyl benzoate, dodecyl benzoate, or 2-ethylhexyl-p-hydroxybenzoate), amides (for example, N,N-diethyldodecanamide, N,N-diethyllaurylamide, or N-tetradecylpyrrolidone), sulfonamides (for example, N-butylbenzenesulfonamide), alcohols or phenols (for example, isostearyl alcohol, or 2,4-di-tert-amylphenol), aliphatic carboxylic acid esters (for example, bis(2-ethylhexyl) sebacate, dioctyl azelate, glycerol tributyrate, isostearyl lactate, or trioctyl citrate), aniline derivatives (for example, N,N-dibutyl-2-butoxy-5-tert-octylaniline), hydrocarbons (for example, paraffin, dodecylbenzene, or diisopropylnaphthalene) and chlorinated paraffins.

Phosphoric acid esters and amides are particularly preferably employed as the high boiling point organic solvent used together with the coupler represented by the formula (1) according to the present invention. At least one compound selected from the phosphoric acid esters and amides is preferably employed alone or together with other high boiling point organic solvent. More preferably, at least one of the phosphoric acid ester is used together with at least one of the amides, or at least one of the phosphoric acid esters and at least one of the amide are used together with other high boiling point organic solvent.

The phosphoric acid esters and amides which are preferably employed in the present invention include those represented by the following formulae (SP) and (SA), respectively.

(SP)

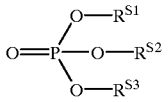

(SA)

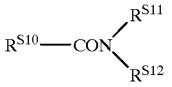

In the formula (SP), $R^{S1}$, $R^{S2}$ and $R^{S3}$, which may be the same or different, each represents an alkyl group or a phenyl group. These groups may be substituted, and examples of the substituent include preferably those described for $R^3$ in the formula (1). The total number of carbon atoms included in $R^{S1}$, $R^{S2}$ and $R^{S3}$ is preferably from 15 to 54. More preferably, all of $R^{S1}$, $R^{S2}$ and $R^{S3}$ are phenyl groups. The substituent for the phenyl group is preferably an alkyl group, more preferably a branched chain alkyl group, and particularly preferably an isopropyl group.

In the formula (SA), $R^{S10}$ and $R^{S11}$, which may be the same or different, each represents an alkyl group or a phenyl group; and $R^{S12}$ represents a hydrogen atom, an alkyl group or a phenyl group. These groups may be substituted, and examples of the substituent include preferably those described for $R^3$ in the formula (1). The total number of carbon atoms included in $R^{S10}$, $R^{S11}$ and $R^{S12}$ is preferably from 10 to 60. $R^{S12}$ is preferably an alkyl group or a phenyl group which may be substituted. More preferably, $R^{S10}$ is a phenyl group which may be substituted.

Of the compounds represented by the formula (SA), those represented by the formula (SA-I) shown below are preferred.

(SA-I)

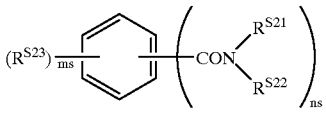

In the formula (SA-I), $R^{S21}$ and $R^{S22}$, which may be the same or different, each represents an alkyl group; $R^{S23}$ represents a substituent and ns represents an integer of from 1 to 6; and ms represents an integer of from 0 to 5. The alkyl group represented by $R^{S21}$ or $R^{S22}$ may be substituted, and examples of the substituent include preferably those described for $R^3$ in the formula (1). ns is preferably an integer of from 1 to 3, more preferably an integer of 2 or 3, and particularly preferably 2. ms is preferably an integer of from 0 to 3, more preferably an integer of 0 or 1, and particularly preferably 0. When ns is an integer of two or more, plural —$CONR^{S21}(R^{S22})$s may be the same or different. When ms is an integer of two or more, plural $R^{S23}$s may be the same or different. When ns is an integer of 2, it is preferred that the position of these groups on the benzene ring is a meta-position or a para-position each other.

Specific examples of the compounds represented by the formula (SP) or (SA) which can be used in the present invention are set forth below, but the present invention should not be construed as being limited thereto.

(SP-1)

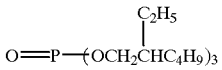

(SP-2)

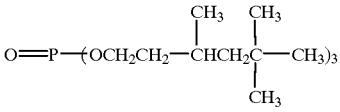

(SP-3)

(SP-4)

(SP-5)

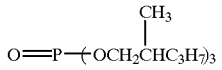

(SP-6)

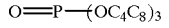

(SP-7)

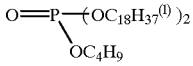

(SP-8)

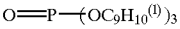

(SP-9)

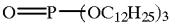

(SP-10)

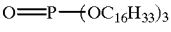

(SP-11)

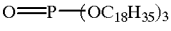

-continued
(SP-12)
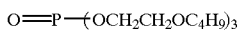
(SP-13)
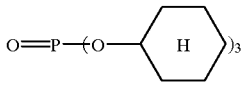
(SP-14)
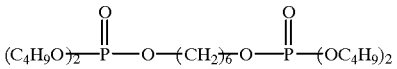
(SP-15)
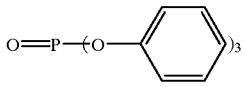
(SP-16)
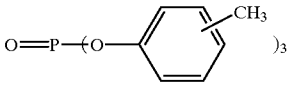
(SP-17)
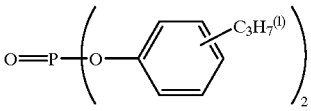
(SP-18)
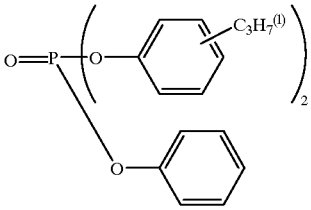
(SP-19)
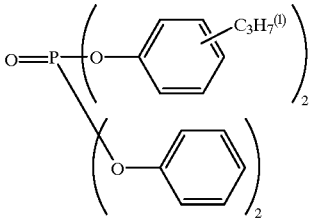
(SP-20)
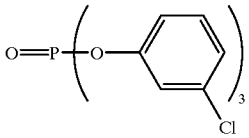
(SP-21)
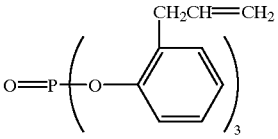
-continued
(SP-22)
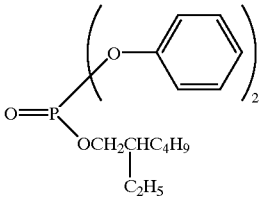
(SP-23)
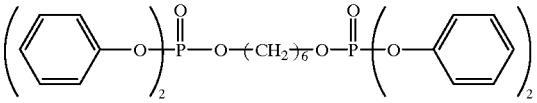
(SA-1)
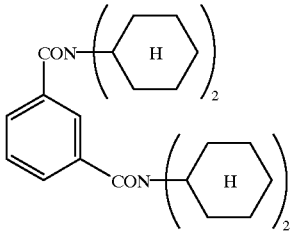
(SA-2)
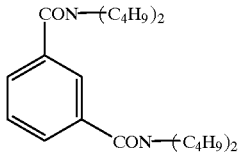
(SA-3)
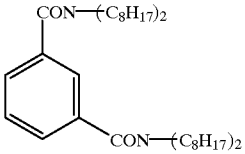
(SA-4)
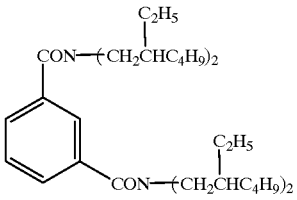
(SA-5)
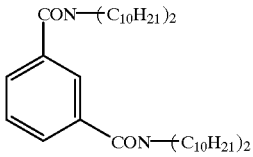
(SA-6)
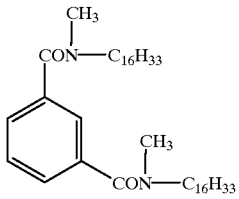

-continued
(SA-7)
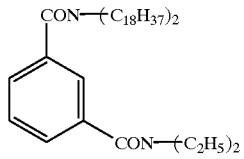
(SA-8)
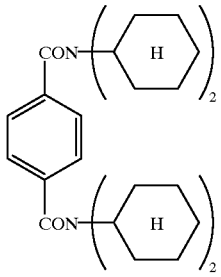
(SA-9)
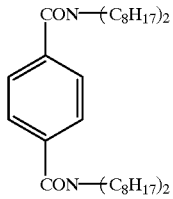
(SA-10)
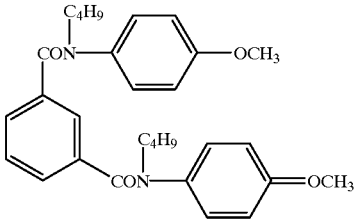
(SA-11)
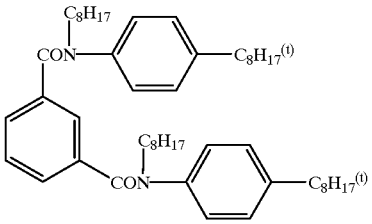
(SA-12)
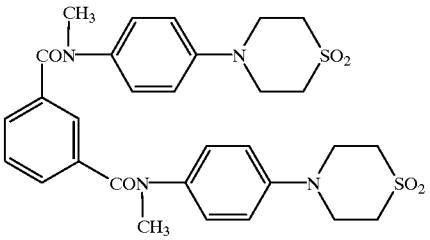
-continued
(SA-13)
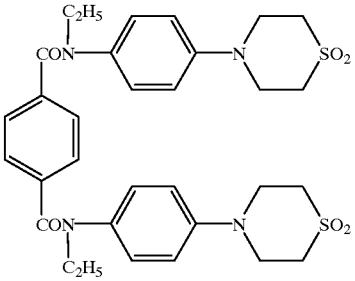
(SA-14)
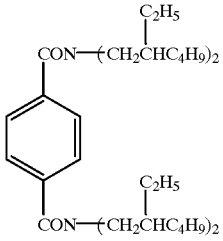
(SA-15)
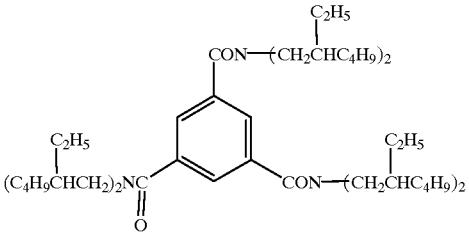
(SA-16)
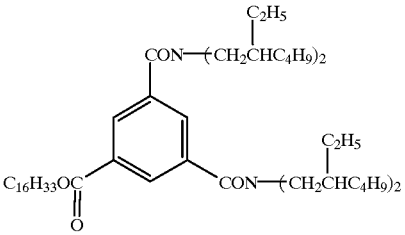
(SA-17)
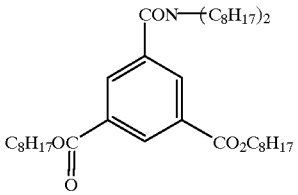
(SA-18)
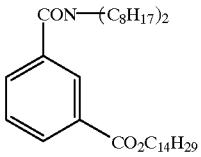
(SA-19)
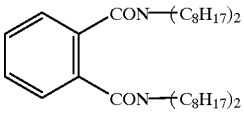

-continued (SA-20)

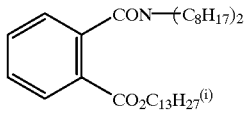

(SA-21)

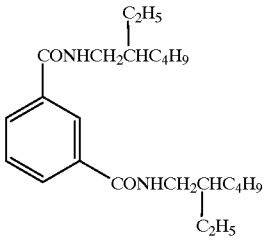

(SA-22)

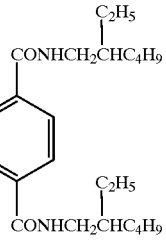

(SA-23)

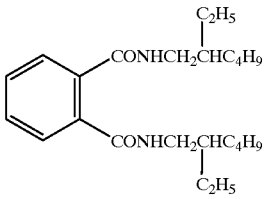

(SA-24)

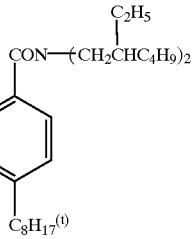

(SA-25)

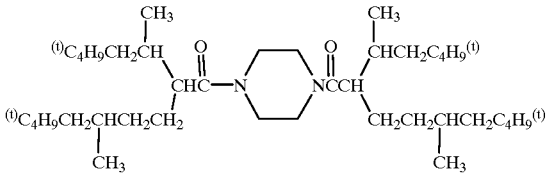

(SA-26)

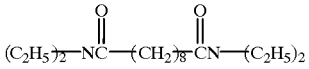

(SA-27)

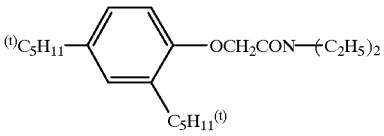

-continued (SA-28)

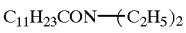

(SA-29)

In the color photographic light-sensitive material according to the present invention, it is preferred to employ the compound represented by the formula (SA), since color reproducibility is remarkably improved.

An organic solvent having a boiling point of not less than 30° C., preferably having a boiling point of from 50° C. to about 160° C. is used as an auxiliary solvent. Typical examples of the organic solvent include ethyl acetate, butyl acetate, ethyl propionate, methyl ethyl ketone, cyclohexanone, 2-ethoxyethyl acetate and dimethylformamide.

It is preferred that a color fading preventing agent, a competing compound, a cyan stain preventing agent which prevents cyan stain caused by an aromatic primary amine developing agent remained in the layer after the color development processing, or a phenolic cyan coupler is employed in addition to the compounds described above in the silver halide emulsion layer containing the cyan dye forming coupler represented by the formula (1) according to the present invention. Suitable examples of these compounds include, in addition to the compounds described in JP-A-62-215272, JP-A-2-33144 and European Laid Open Patent 335,660, the compounds described in JP-A-5-150426, U.S. Pat. Nos. 5,352,573 and 5,330,888, European Laid Open Patent 606,659 and Japanese Patent Application No. 8-126445 as the color fading preventing agent; hydroquinones, catechols, gallic acid compounds, sulfonamidobenzenes, hydrazines, hydroxylamines and dissolving-out type couplers, specifically the compounds described in U.S. Pat. Nos. 5,330,888, 5,403,704 and 5,547,825 and JP-A-6-83002 as the competing compound; the compounds described in European Laid Open Patent 544,317 as the cyan stain preventing agent which prevents cyan stain caused by an aromatic primary amine developing agent remained in the layer after the color development processing; and the compounds described in U.S. Pat. No. 5,378,596 and Japanese Patent Application No. 8-101556 as the phenolic cyan coupler.

The use of the color fading preventing agent, competing compound, cyan stain preventing agent and phenolic cyan coupler is particularly preferred since the synergistic effect can be obtained rather than achievement of the individual purpose of color fading prevention, color mixing prevention, cyan stain prevention or improvement in color reproducibility.

In the silver halide color photographic light-sensitive material according to the present invention, other various conventionally known photographic elements and additives can be employed.

For instance, a transmissive type support or reflective type support is used as a support for the photographic material of the present invention. Among the transmissive type support, a transparent film such as a cellulose triacetate film or a polyethylene terephthalate film, and a polyester film composed of 2,6-naphthalene-dicarboxylic acid (NDCA) and ethylene glycol (EG) or composed of NDCA, terephthalic acid and EG having provided thereon an information recording layer such as a magnetic layer are preferably employed. Of the reflective type supports, a laminate composed of plural water-resistant resin layers such as polyethylene layers or polyester layers and containing a white pigment such as titanium oxide in at least one of the resin layers is preferred.

It is preferred that the water-resistant resin layer contains a fluorescent whitening agent. The fluorescent whitening agent may also be dispersed in a hydrophilic colloid layer of the photographic light-sensitive martial. Preferred fluorescent whitening agents used include benzoxazole series, cumarin series and pyrazoline series compounds. Fluorescent whitening agents of benzoxazolyl naphthalene series and benzoxazolyl stilbene series are more preferably used. The amount of the fluorescent whitening agent to be used is not particularly limited and preferably in a range of from 1 to 100 mg/m$^2$. A mixing ratio of the fluorescent whitening agent to be used in the water-resistant resin layer is preferably from 0.0005 to 3% by weight, and more preferably from 0.001 to 0.5% by weight of the resin.

Further, a transmissive type support and a reflective type support each having provided thereon a hydrophilic colloid layer containing a white pigment may be employed.

Moreover, a support having a mirror plate reflective metal surface or a secondary diffusion reflective metal surface may be used as the reflective type support.

A silver chloride or silver chlorobromide emulsion having a silver chloride content of 95 mol % or more is preferably employed as the silver halide emulsion in the color photographic light-sensitive material of the present invention in view of rapid processing suitability. Further, a silver halide emulsion having a silver chloride content of 98 mol % or more is more preferred. Of these silver halide emulsions, those having a silver bromide localized phase on the surface of silver chloride grain is particularly preferred, since high sensitivity as well as stabilization of photographic characteristics are achieved.

With respect to the reflective type support, silver halide emulsion, heterogeneous metal ion doped in silver halide grain, stabilizer and antifoggant for silver halide emulsion, chemical sensitization (chemical sensitizer), spectral sensitization (spectral sensitizer), cyan coupler, magenta coupler, yellow coupler,-emulsified dispersion method of coupler, color image stabilizer (anti-staining agent), color fading preventing agent, dye (colored layer), gelatin, layer construction of photographic material and pH of coated layer, those described in the patents shown in Table 1 and Table 2 below are preferably used in the present invention.

TABLE 1

| Photographic Element | JP-A-7-104448 | JP-A-7-77775 | JP-A-7-310895 |
|---|---|---|---|
| Reflective Type Support | Col. 7, line 12 to Col. 12, line 19 | Col. 35, line 43 to Col. 44, line 1 | Col. 5, line 40 to Col. 9, line 26 |
| Silver Halide Emulsion | Col. 72, line 29 to Col. 74, line 18 | Col. 44, line 36 to Col. 46, line 29 | Col. 77, line 48 to Col. 80, line 28 |
| Heterogeneous Metal Ion | Col. 74, lines 19 to 44 | Col. 46, line 30 to Col. 47, line 5 | Col. 18, line 29 to Col. 81, line 26 |
| Stabilizer and Antifoggant | Col. 75, lines 9 to 18 | Col. 47, lines 20 to 29 | Col. 18, line 11 to Col. 31, line 37 (particularly, mercapto heterocyclic compound) |

TABLE 1-continued

| Photographic Element | JP-A-7-104448 | JP-A-7-77775 | JP-A-7-310895 |
|---|---|---|---|
| Chemical Sensitization (Chemical Sensitizer) | Col. 74, line 45 to Col. 75, line 6 | Col. 47, lines 7 to 17 | Col. 81, lines 9 to 17 |
| Spectral Sensitization (Spectral Sensitizer) | Col. 75, line 19 to Col. 76, line 45 | Col. 47, line 30 to Col. 49, line 6 | Col. 81, line 21 to Col. 82, line 48 |
| Cyan Coupler | Col. 12, line 20 to Col. 39, line 49 | Col. 62, line 50 to Col. 63, line 16 | Col. 88, line 49 to Col. 89, line 16 |
| Yellow Coupler | Col. 87, lie 40 to Col. 88, line 3 | Col. 63, lines 17 to 30 | Col. 89, lines 17 to 30 |

TABLE 2

| Photographic Element | JP-A-7-104448 | JP-A-7-77775 | JP-A-7-310895 |
|---|---|---|---|
| Magenta Coupler | Col. 88, lines 4 to 18 | Col. 63, line 31 to Col. 64, line 11 | Col. 32, line 34 to Col. 77, line 44 and Col. 89, lines 32 to 46 |
| Emulsified Dispersion Method of Coupler | Col. 71, line 3 to Col. 72, line 11 | Col. 61, lines 36 to 49 | Col. 87, lines 35 to 48 |
| Color Image Stabilizer (Anti-staining Agent) | Col. 39, line 50 to Col. 70, line 9 | Col. 651, line 50 to Col. 62, line 49 | Col. 87, line 49 to Col. 88, line 48 |
| Color Fading Preventing Agent | Col. 70, line 10 to Col. 71, line 2 | | |
| Dye (Colored Layer) | Col. 77, line 42 to Col. 78, line 41 | Col. 7, line 14 to Col. 19, line 42 and Col. 50, line 3 to Col. 51, line 14 | Col. 9, line 27 to Col. 18, line 10 |
| Gelatin | Col. 78, lines 42 to 48 | Col. 51, lines 15 to 20 | Col. 83, lines 13 to 19 |
| Layer Construction of Photographic Material | Col. 39, lines 11 to 26 | Col. 44, lines 2 to 35 | Col. 31, lines 38 to Col. 32, line 33 |
| Ph of Coated Layer | Col. 72, lines 12 to 28 | | |
| Scanning Exposure | Col. 76, line 6 to Col. 77, line 41 | Col. 49, line 7 to Col. 50, line 2 | Col. 82, line 49 to Col. 83, line 12 |
| Preservative in Developing Solution | Col. 88, line 19 to Col. 89, line 22 | | |

The cyan couplers, magenta couplers and yellow couplers which can be suitably employed in the present invention also include those described in JP-A-62-215272, page 91 right upper column, line 4 to page 121, left upper column, line 6, JP-A-2-33144, page 3, right upper column, line 14 to page 18, left upper column, last line and page 30, right upper column, line 6 to page 35, right lower column, line 11, and EP-A-355660, page 4, lines 15 to 27, page 5, line 30 to page 28, last line, page 45, lines 29 to 31 and page 47, line 23 to page 63, line 50.

The bactericides and anti-mold agents described in JP-A-63-271247 are suitably used in the present invention.

Gelatin is preferably employed as a hydrophilic colloid in a photographic layer constituting the photographic light-sensitive material according to the present invention. An amount of heavy metal, for example, iron, copper, zinc or manganese, which is included as an impurity in gelatin, is preferably not more than 5 ppm, more preferably not more than 3 ppm.

The silver halide photographic light-sensitive material according to the present invention is suitable for a scanning exposure system using a cathode ray tube (CRT) in addition to a conventional printing system using a negative printer.

An exposure device using a cathode ray tube is simple, compact and low-cost in comparison with an exposure device using a laser beam. Also, the former is advantageous in view of easy control of an optical axis and color.

In the cathode ray tube used for the image exposure, various light emitting materials which emit light in the spectrum are employed depending on the demand. For instance, a red light emitting material, a green light emitting material and a blue light emitting material are used individually or a combination of two or more thereof. The light emitting materials are not limited to those of red, green and blue described above, and other light emitting materials which emit yellow light, orange light, purple light or infrared light may also be utilized. Particularly, a cathode ray tube using a combination of these light emitting materials to emit white light is frequently employed.

When the photographic light-sensitive material having a plural of light-sensitive layers each having a different spectral sensitivity and the cathode ray tube having a plural of light emitting materials each emitting light having a different spectrum are used, a plural of color image signals are input to the cathode ray tube to emit the respective light and a plural of colors are exposed at once. Alternatively, a successive exposure method wherein each color light is emitted according to the input of the corresponding image signal, in order, and filters which cut color light other than the desired color light are used can be adapted. In general, the successive exposure method is preferred to obtain high quality images, since a cathode ray tube of high resolving power can be used.

The photographic light-sensitive material of the present invention can preferably be used in digital scanning exposure system using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, and at least one of exposure light sources should be a semiconductor laser.

When such a scanning exposure light source is used, the spectral sensitivity maximum of the photographic light-sensitive material of the present invention can be appropriately set according to the wavelength of the scanning exposure light source to be used. As an oscillation wavelength of a laser can be made half using an SHG light source comprising a combination of non-linear optical crystal with a solid state laser using a semiconductor laser as an excitation light source or a semiconductor laser, blue light and green light can be obtained. Accordingly, it is possible to have the spectral sensitivity maximum of the photographic light-sensitive material in normal three regions of blue, green and red.

The exposure time in the scanning exposure is defined as the time necessary to expose the pixel size with the pixel density being 400 dpi, and preferred exposure time is $10^{-4}$ second or less and more preferably $10^{-6}$ second or less.

Preferred scanning exposure systems suitable for use in the present invention are described in detail in the patents set forth in the table shown above.

In order to process the silver halide photographic light-sensitive material of the present invention, processing elements and processing methods described in JP-A-2-207250, page 26, right lower column, line 1 to page 34, right upper column, line 9 and JP-A-4-97355, page 5, left upper column, line 17 to page 18, right lower column, line 20 are preferably employed. As preservatives in developing solution, the compounds described in the patents set forth in the table shown above are preferably employed.

In order to conduct development processing of the photographic light-sensitive material according to the present invention after imagewise exposure, a wet type developing process, for example, a developing method using a conventional developing solution containing an alkaline agent and a developing agent, and an activator method in which a photographic light-sensitive material containing a developing agent is developed with an activator solution such as an alkaline solution containing no developing agent, as well as a dry type developing process without using a processing solution, for example, a heat developing method can be employed. Particularly, the activator method is preferred since the processing solution does not contain a developing agent, thus the control and handling of the processing solution are easy. Also, it is favorable in view of the environmental conservation since a load for treatment of the waste solution is small.

The developing agents and precursors thereof which can be incorporated into the photographic light-sensitive material used in the activator method are preferably hydrazine series compounds described, for example, in Japanese Patent Application Nos. 7-63572, 7-334190, 7-334192, 7-334197 and 7-344396.

Further, a developing method wherein the photographic light-sensitive material having a reduced coating amount of silver is subjected to an image amplification process (intensification process) using hydrogen peroxide is preferably employed. In particular, it is preferred to apply this method to the activator method. Specifically, an image forming method using the activator solution containing hydrogen peroxide as described in Japanese Patent Application Nos. 7-64587 and 7-334202 is preferably employed.

According to the activator method, the photographic material is ordinarily subjected to a desilvering treatment after the treatment with the activator solution. However, in the image amplification process using the photographic material having a reduced coating amount of silver, the desilvering treatment is omitted and a simple treatment such as washing with water or stabilizing treatment is conduced. Further, in a system wherein an image information is read from a photographic material by a scanner, the processing method omitting the desilvering treatment can be adopted, even when a photographic light-sensitive material having a large coating amount of silver such as a photographic light-sensitive martial for photographing is processed.

Processing elements and processing methods for the activator treatment, desilvering (bleaching/fixing), water washing and stabilizing used in the present invention include those known in the art. Preferably, those described in *Research Disclosure*, September 1994, Item 36544, pages 536 to 541 and Japanese Patent Application No. 7-63572 are employed.

The silver halide color photographic light-sensitive material according to the present invention provides color images excellent in color reproducibility and color image fastness, particularly to light in a broad wavelength range extending from ultraviolet to visible.

The present invention will be explained in greater detail with reference to the following examples, but the present invention should not be construed as being limited thereto.

EXAMPLE 1

A surface of a paper support laminated with polyethylene on both sides was subjected to a corona discharge treatment. On the surface subjected to the corona discharge treatment was provided a gelatin undercoat layer containing sodium dodecylbenzenesulfonate, and various photographic constituent layers described below were coated thereon to prepare a silver halide multilayer color photographic printing paper designated Sample 101. Coating solutions of the layers were prepared as follows.

Preparation of Coating Solution for Fifth Layer

In 50 ml of ethyl acetate were dissolved 19 g of Cyan Coupler (1) of the formula (1) according to the present invention, 2.5 g of High Boiling-Point Organic Solvent (SA-1), 16.4 ml of Solvent (Solv-9), 1.0 g of Color Fading Preventing Agent (ADA-1), 1.2 g of color Image Stabilizer (ADF-1), 1.2 g of Color Image Stabilizer (ADF-2), 6.0 g of Color Image Stabilizer (Cpd-14), 7.5 g of Color Image Stabilizer (Cpd-18), 13.0 g of Color Image Stabilizer (Cpd-19), 1.2 g of Color Image Stabilizer (Cpd-6) and 10.0 g of Color Image Stabilizer (Cpd-8). The ethyl acetate solution was added to 500 g of 20% aqueous gelatin solution containing 2.9 g of Surface Active Agent (Cpd-13) and the mixture was emulsified and dispersed, followed by adding water to make the total amount into one Kg, whereby Emulsified Dispersion C having an average particle size of 0.15 $\mu$m was prepared.

Separately, Silver Chlorobromide Emulsion C was prepared (a cubic form, a mixture in a ratio of ¼ (silver mol ratio) of a large grain size emulsion having an average grain size of 0.55 $\mu$m and a small grain size emulsion having an average grain size of 0.42 $\mu$m, variation coefficients of the grain size distribution being 0.09 and 0.11, respectively, both of them being composed of silver chloride substrate grains having 0.8 mol % of silver bromide localized in a part of their surface). The red-sensitive Sensitizing Dyes G and H shown below were added each in an amount of $5.0\times10^{-5}$ mol per mol of silver to the large grain size emulsion, and each in an amount of $8.0\times10^{-5}$ mol per mol of silver to the small grain size emulsion. Further, Additive X shown below was added in an amount of $2.6\times10^{-3}$ mmol per mol of silver halide. The silver chlorobromide emulsion was subjected optimally to chemical ripening by adding a sulfur sensitizer and a gold sensitizer.

Emulsified Dispersion C described above was mixed with Silver Chlorobromide Emulsion C and tho mixture was dissolved to prepare a coating solution for the fifth layer having the composition shown below. A coating amount of the silver halide emulsion is indicated by the coating amount in terms of silver.

The coating solutions for the first to seventh layers other than the fifth layer were prepared in a manner similar to the coating solution for the fifth layer. These coating solutions were coated 15 minutes after the preparation thereof. 1-Oxy-3,5-dichloro-s-triazine sodium salt was used as a gelatin hardening agent in each layer.

Further, Preservatives AS-1, AS-2, AS-3 and AS-4 shown below were added to each layer so that the total coating amount became 15.0 mg/m$^2$, 6.0 mg/m$^2$, 5.0 mg/m$^2$ and 10.0 mg/m$^2$, respectively.

The spectral sensitizing dyes used for the silver chlorobromide emulsions of the light-sensitive layers are shown below.

Sensitizing Dyes for Blue-Sensitive Emulsin Layer

Sensitizing Dye A

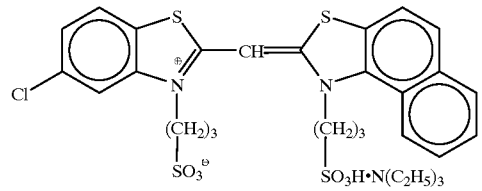

Sensitizing Dye B

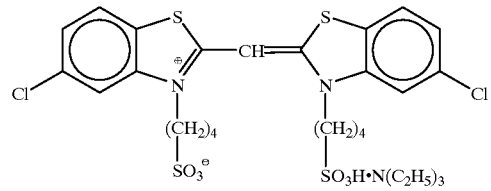

Sensitizing Dye C

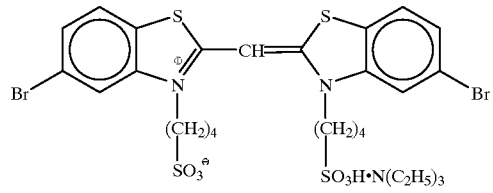

(each was used in an amount of $1.4\times10^{-4}$ mol per mol of the silver halide for the large grain size emulsion and in an amount of $1.7\times10^{-4}$ mol per mol of the silver halide for the small grain size emulsion.)

Sensitizing Dyes for Green-Sensitive Emulsion Layer

Sensitizing Dye D

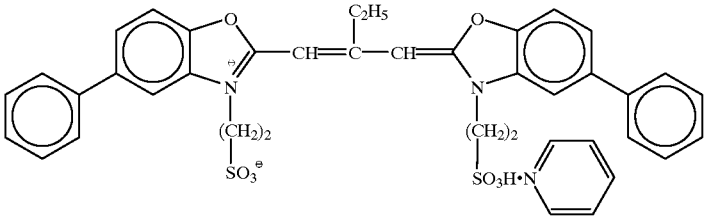

-continued

Sensitizing Dye E

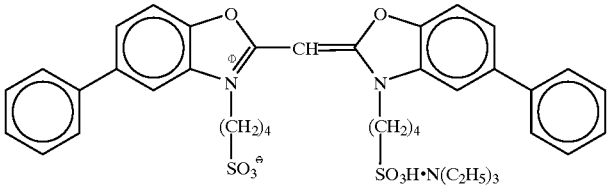

Sensitizing Dye F

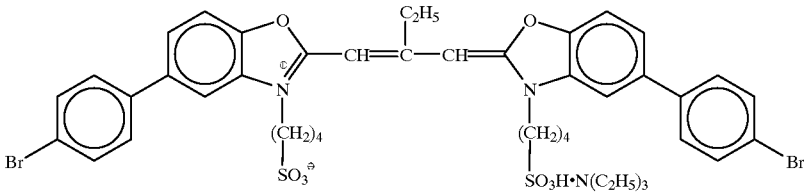

(Sensitizing Dye D was used in an amount of $3.0\times10^{-4}$ mol per mol of the silver halide for the large grain size emulsion and in an amount of $3.6\times10^{-4}$ mol per mol of the silver halide for the small grain size emulsion; Sensitizing Dye E was used in an amount of $4.0\times10^{-5}$ mol per mol of the silver halide for the large grain size emulsion and in an amount of $7.0\times10^{-5}$ mol per mol of the silver halide for the small grain size emulsion; and Sensitizing Dye F was used in an amount of $2.0\times10^{-4}$ mol per mol of the silver halide for the large grain size emulsion and in an amount of $2.8\times10^{-4}$ mol per mol of the silver halide for the small grain size emulsion.)

Sensitizing Dyes for Red-Sensitive Emulsion Layer

Sensitizing Dye G

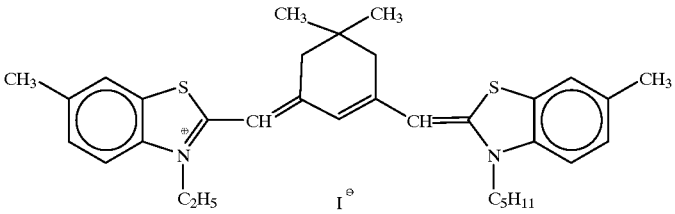

Sensitizing Dye H

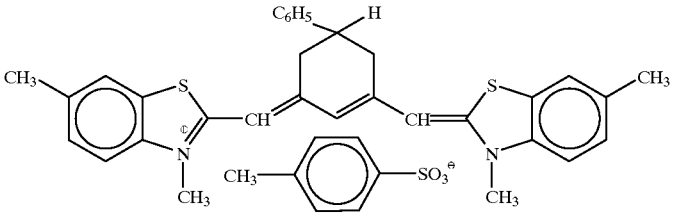

(each was used in an amount of $5.0\times10^{-5}$ mol per mol of the silver halide for the large grain size emulsion and in an amount of $8.0\times10^{-5}$ mol per mol of the silver halide for the small grain size emulsion.)

Further, Additive X shown below was added to the emulsion layer in an amount of $2.6\times10^{-3}$ mol per mol of silver halide.

Additive X

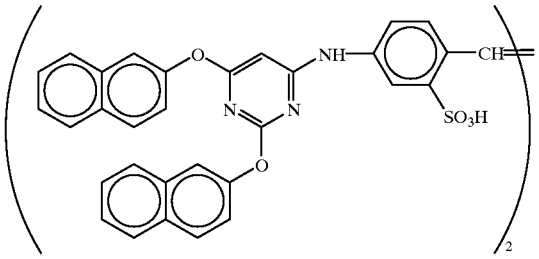

Further, 1-(5-methylureidophenyl)-5-mercapto-tetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol-of the silver halide. Also, the mercaptotetrazole compound was added to the second layer, the fourth layer, the sixth layer and the seventh layer in an amount of 0.2 mg/m$^2$, 0.2 mg/m$^2$, 0.6 mg/m$^2$ and 0.1 mg/m$^2$, respectively.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of the silver halide.

Moreover, the following compounds were added separately to the second layer, the fourth layer and the sixth layer as irradiation preventing water-soluble dyes.

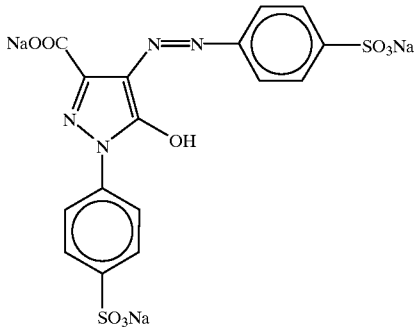

(10 mg/m$^2$)

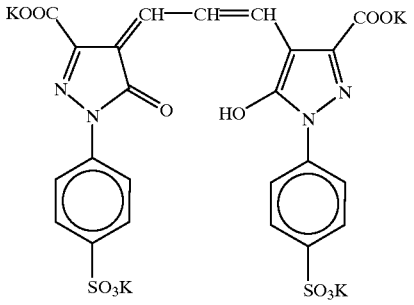

(10 mg/m$^2$)

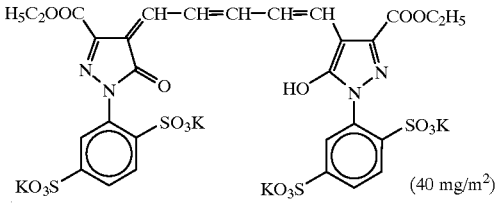

(40 mg/m$^2$)

and

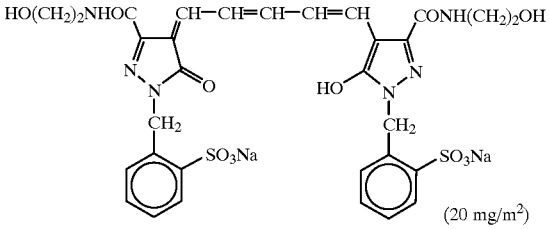

(20 mg/m$^2$)

Layer Construction

The composition of each layer is described below. The numeral represents the coating amount (g/m$^2$). The numeral for silver halide emulsion represents the coating amount in terms of silver.

Support

Polyethylene-laminated paper containing a white pigment ($TiO_2$) in an amount of 15 wt % and a bluish dye (ultramarine) in the polyethylene laminated layer on the side of the first layer.

| First Layer (blue-sensitive emulsion layer) | |
|---|---|
| Silver Chlorobromide Emulsion (a cubic form, a mixture in a ratio of 3/7 (silver mol ratio) of a large grain size emulsion having an average grain size of 0.88 μm and a small grain size emulsion having an average grain size of 0.70 μm; variation coefficients of the grain size distribution being 0.08 and 0.10, respectively, both of them containing 0.3 mol % of silver bromide localized at a part of the surface of each grain having silver chloride as substrate) | 0.26 |
| Gelatin | 1.4 |
| Yellow Coupler (ExY) | 0.64 |
| Color Image Stabilizer (Cpd-1) | 0.078 |
| Color Image Stabilizer (Cpd-2) | 0.038 |
| Color Image Stabilizer (Cpd-3) | 0.085 |
| Color Image Stabilizer (Cpd-5) | 0.020 |
| Color Image Stabilizer (Cpd-15) | 0.05 |
| Solvent (Solv-1) | 0.11 |
| Solvent (Solv-6) | 0.11 |
| Second Layer (color-mixing preventing layer) | |
| Gelatin | 1.0 |
| Color Mixing Preventing Agent (Cpd-4) | 0.11 |
| Solvent (Solv-1) | 0.06 |
| Solvent (Solv-2) | 0.22 |
| Solvent (Solv-3) | 0.08 |
| Solvent (Solv-8) | 0.01 |
| Ultraviolet Absorber (UV-B) | 0.07 |
| Third Layer (green-sensitive emulsion layer) | |
| Silver Chlorobromide Emulsion (a cubic form, a mixture in a ratio of 1/3 (silver mol ratio) of a large grain size emulsion having an average grain size of 0.55 μm and a small grain size emulsion having an average grain size of 0.39 μm; variation coefficients of the grain size distribution being 0.10 and 0.08, respectively, both of them containing 0.7 mol % of silver bromide localized at a part of the surface of each grain having silver chloride as substrate) | 0.11 |
| Gelatin | 1.3 |
| Magenta Coupler (ExM) | 0.13 |
| Ultraviolet Absorber (UV-A) | 0.12 |
| Color Image Stabilizer (Cpd-2) | 0.010 |
| Color Image Stabilizer (Cpd-5) | 0.020 |
| Color Image Stabilizer (Cpd-6) | 0.010 |
| Color Image Stabilizer (Cpd-14) | 0.080 |
| Color Image Stabilizer (Cpd-8) | 0.030 |
| Color Image Stabilizer (Cpd-16) | 0.002 |
| Solvent (Solv-3) | 0.15 |
| Solvent (Solv-4) | 0.22 |
| Solvent (Solv-6) | 0.11 |
| Fourth Layer (color-mixing preventing layer) | |
| Gelatin | 1.0 |
| Color Mixing Preventing Agent (Cpd-4) | 0.20 |
| Solvent (Solv-1) | 0.03 |
| Solvent (Solv-2) | 0.11 |
| Solvent (Solv-3) | 0.04 |
| Solvent (Solv-8) | 0.01 |
| Ultraviolet Absorber (UV-B) | 0.04 |
| Fifth Layer )red-sensitive emulsion layer) | |
| Silver Chlorobromide Emulsion (a cubic form, a mixture in a ratio of 1/4 (silver mol ratio) of a large grain size emulsion having an average grain size of 0.55 μm and a small grain size emulsion having an average grain size of 0.42 μm; variation coefficients of the grain size | 0.085 |

-continued

| | |
|---|---|
| distribution being 0.09 and 0.11, respectively, both of them containing 0.8 mol % of silver bromide localized at a part of the surface of each grain having silver chloride as substrate) | |
| Gelatin | 0.99 |
| Cyan Coupler (1) | 0.15 |
| Solvent (Solv-9) | 0.13 |
| Solvent (SA-1) | 0.02 |
| Color Fading Preventing Agent (ADA-1) | 0.008 |
| Color Image Stabilizer (ADF-1) | 0.01 |
| Color Image Stabilizer (ADF-2) | 0.01 |
| Color Image Stabilizer (Cpd-14) | 0.05 |
| Color Image Stabilizer (Cpd-18) | 0.06 |
| Color Image Stabilizer (Cpd-19) | 0.10 |
| Color Image Stabilizer (Cpd-6) | 0.01 |
| Color Image Stabilizer (Cpd-8) | 0.08 |
| Sixth Layer (ultraviolet absorbing layer) | |
| Gelatin | 0.63 |
| Ultraviolet Absorber (UV-C) | 0.35 |
| Color Image Stabilizer (Cpd-14) | 0.050 |
| Solvent (Solv-7) | 0.050 |
| Seventh Layer (protective layer) | |
| Acid Treated Gelatin | 1.0 |
| Acryl-Modified Copolymer of Polyvinyl Alcohol (modification degree: 17%) | 0.043 |
| Liquid Paraffin | 0.018 |
| Surface Active Agent (Cpd-17) | 0.026 |

The compounds used for preparing the composition of each layer described above are shown below.

(ExY) Yellow Coupler

A 1/1 mixture by mol ratio of

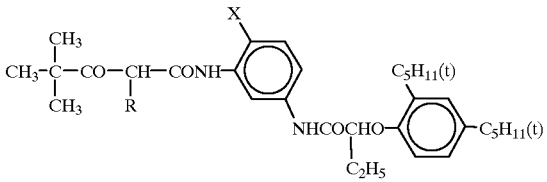

R =

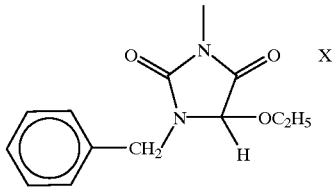

X = Cl and

R =

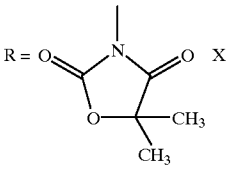

X = $OCH_3$ (ExM) Magenta Coupler

A 1/1 mixture by mol ratio of

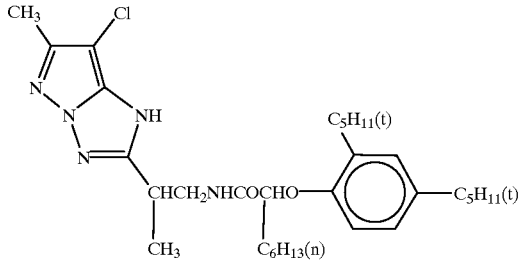

and

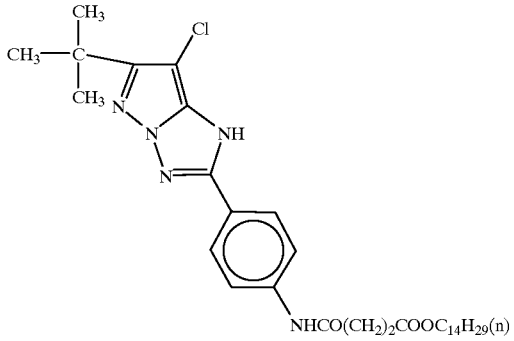

(Cpd-1) Coupler Image Stabilizer

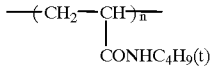

number average molecular weight: 60,000

(Cpd-2) Color Image Stabilizer

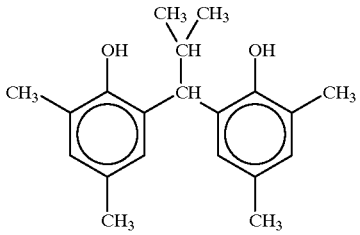

(Cpd-3) Color Image Stabilizer

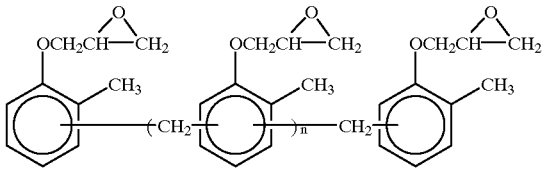

n=7 to 8 (average value)

(Cpd-4) Color Mixing Preventing Agent

A 1/1/1 mixture by weight ratio of

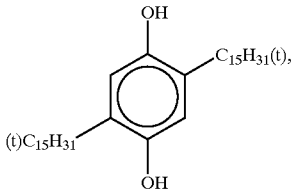

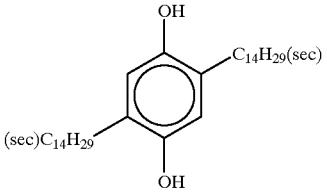

and

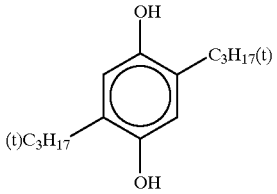

(Cpd-5) Color Image Stabilizer

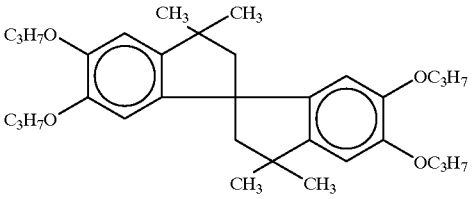

(Cpd-6) Color Image Stabilizer

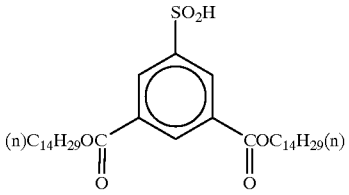

(Cpd-7) Color Image Stabilizer

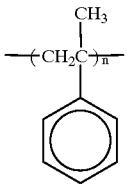

number average molecular weight: 600

(Cpd-8) Color Image Stabilizer

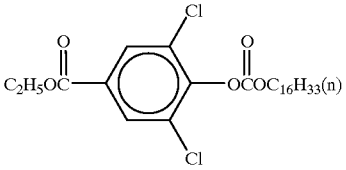

(Cpd-9) Color Image Stabilizer

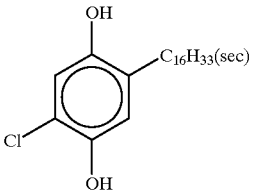

(Cpd-10) Surface Active Agent

A 1/1/1 mixture by weight ratio of

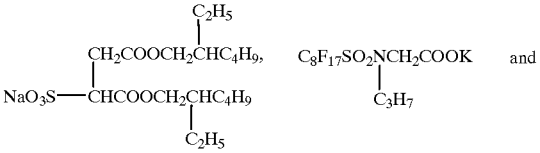

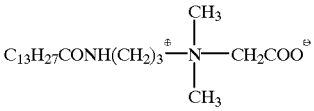

(Cpd-11) Preservative

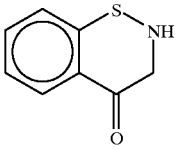

(Cpd-12) Preservative

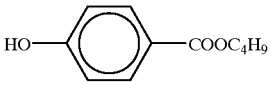

(Cpd-13) Surface Active Agent

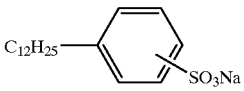

(Solv-1) Solvent

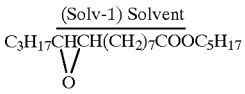

-continued
(Solv-2) Solvent
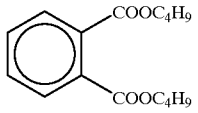
(Solv-3) Solvent
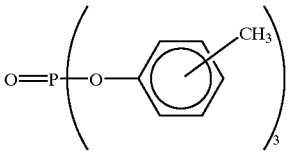
(Solv-4) Solvent
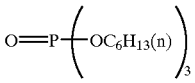
(Solv-5) Solvent
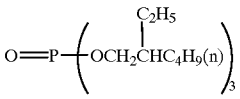
(Solv-6) Solvent
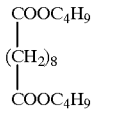
(Solv-7) Solvent
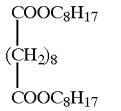
(Solv-8) Solvent
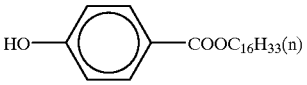
(Solv-9) Solvent
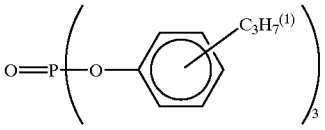
(Cpd-14) Color Image Stabilizer
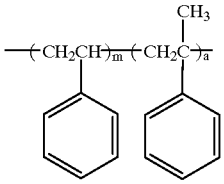
number average molecular weight: 600 m/n=10/90
(Cpd-15) Color Image Stabilizer
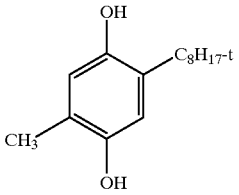
(Cpd-16) Color Image Stabilizer
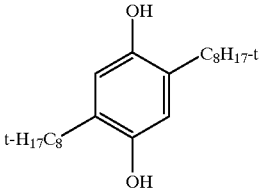
(Cpd-17) Surface Active Agent
A 3/1/3 mixture by weight ratio of (1), (2) and (3)
(1)
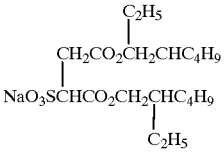
(2)
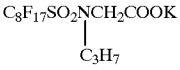
(3)
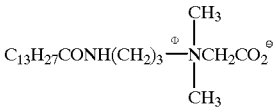
(Cpd-18) Color Image Stabilizer
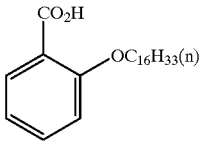
(Cpd-19) Color Image Stabilizer
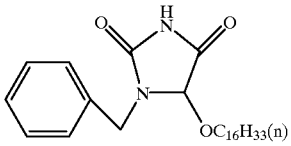

(ADA-1) Color Fading Preventing Agent
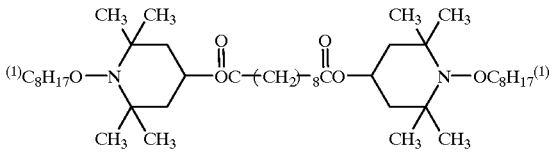
(ADF-1) Color Image Stabilizer
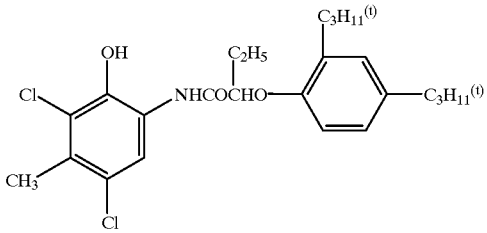
(ADF-2) Color Image Stabilizer
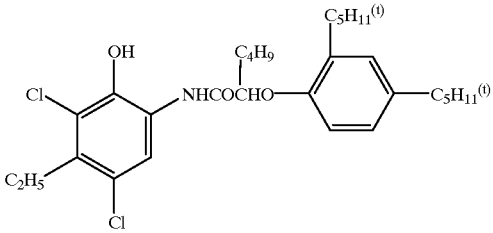
(UV-1) Ultraviolet Absorber
A 5/2/2/1 mixture by weight ratio of (1), (2), (3) and (4)
(1)
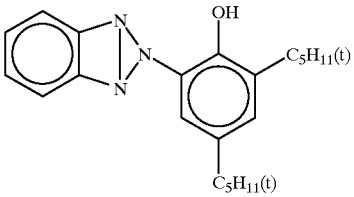
(2)
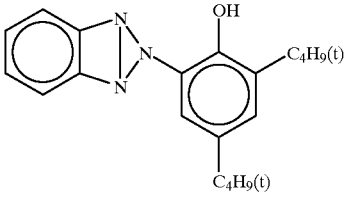
(3)
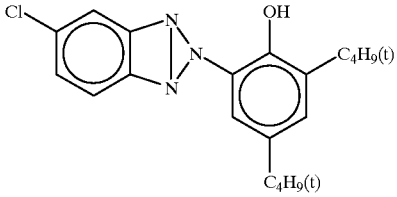
-continued
(4)
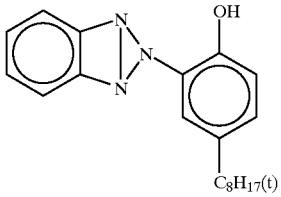
(UV-B) Ultraviolet Absorber
A 5/2/2/2/1 mixture by weight ratio of (1), (2), (3), (4) and (5)
(1)
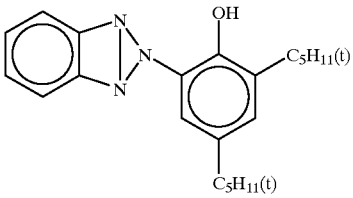
(2)
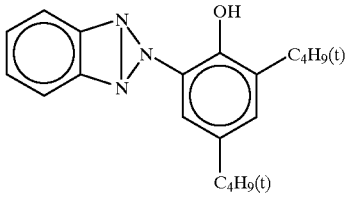
(3)
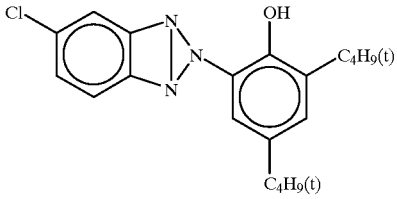
(4)
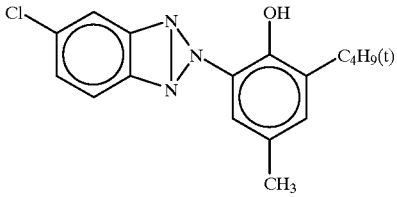
(5)
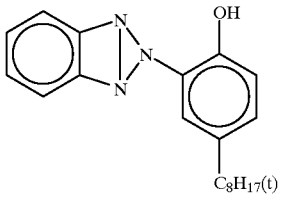
(UV-C) Ultraviolet Absorber
A 6/2/2/2/3/1 mixture by weight ratio of (1), (2), (3), (4), (5) and (6)

(1)

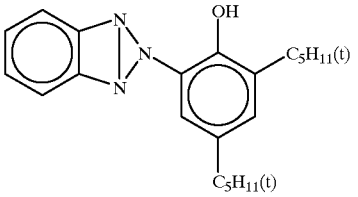

(2)

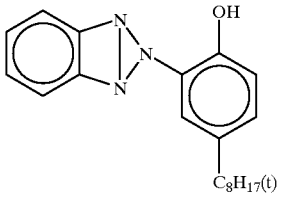

(3)

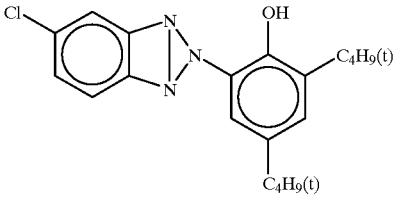

(4)

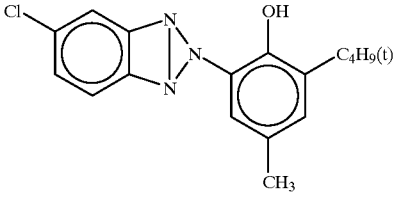

(5)

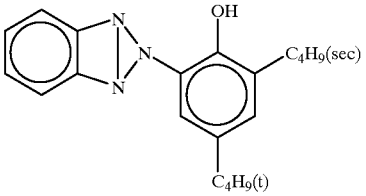

(6)

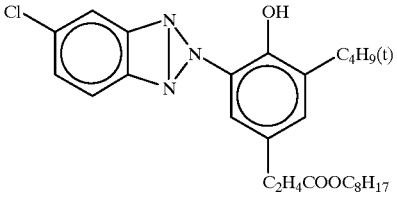

(AS-1) Preservative

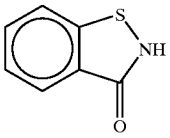

(AS-2) Preservative

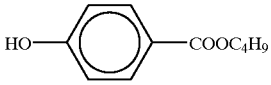

(AB-3) Preservative

A 1/1/1/1 mixture by weight ratio of a, b, c and d

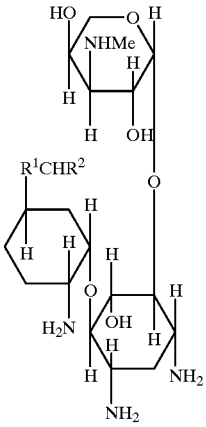

| | $R^1$ | $R^2$ |
|---|---|---|
| a | —Me | —NHMe |
| b | —Me | —$NH_2$ |
| c | —H | —$NH_2$ |
| d | —H | —NHMe |

(AS-4) Preservative

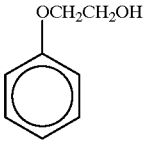

Samples 102 to 127 were prepared in the same manner as in Sample 101 except for changing the composition of the fifth layer to those shown in Tables 3 to 6 below, respectively. In each sample, the cyan coupler of the formula (1) was used in an equimolar amount. An average particle size of oleophilic fine particle containing the cyan coupler prepared during the preparation of each sample was in a range of from 0.13 to 0.15 $\mu$m.

The samples thus-prepared were stored at room temperature for 14 days and then subjected to the following evaluation.

First, Sample 104 was imagewise exposed so that about 30% of the coated amount of silver was developed and subjected to continuous processing using a processing machine for color paper according to the processing steps shown below until the total replenishing amount reached two times of the tank capacity of the color developing solution.

| Processing Step | Processing Temperature (° C.) | Processing Time (sec) | Replenishment Rate* (ml) | Tank Capacity (ml) |
|---|---|---|---|---|
| Color Development | 38.5 | 45 | 73 | 500 |
| Bleach-Fixing | 30–35 | 45 | 60 | 500 |

-continued

| Processing Step | Processing Temperature (° C.) | Processing Time (sec) | Replenishment Rate* (ml) | Tank Capacity (ml) |
|---|---|---|---|---|
| Rinsing (1) | 30–35 | 20 | | 500 |
| Rinsing (2) | 30–35 | 20 | | 500 |
| Rinsing (3) | 30–35 | 20 | 370 | 500 |
| Drying | 70–80 | 60 | | |

*Replenishment rate per $m^2$ of the photographic material Rinsing was conducted in a 3-tank countercurrent system from rinsing (3) to rinsing (1).

The composition of each processing solution was as follows.

| Color Developing Solution | Tank Solution | Replenisher |
|---|---|---|
| Water | 700 ml | 700 ml |
| Sodium Triisopropylene(β)-sulfonate | 0.1 g | 0.1 g |
| Ethylenediaminetetraacetic Acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Fluorescent Whitening Agent (WHITEX 4, manufactured by Sumitomo Chemical Co., Ltd.) | 1.0 g | 3.0 g |
| Sodium Sulfite | 0.1 g | 0.1 g |
| Diethylhydroxylamine | 1.0 g | 1.0 g |
| Disodium-N,N-bis(sulfonato-ethyl)hydroxylamine | 10.0 g | 13.0 g |
| N-Ethyl-N-(β-methanesulfon amidoethyl)-3-methyl-4-amino aniline Sulfate | 5.0 g | 11.5 g |
| Water to make | 1,000 ml | 1,000 ml |
| Ph (25° C.) | 10.0 | 10.0 |

Bleach-Fixing Solution (tank solution and replenisher are the same)

| | |
|---|---|
| Water | 600 ml |
| Ammonium Thiosulfate (700 g/liter) | 100 ml |
| Sodium Sulfite | 40 g |
| Ammonium Ethylenediaminetetraacetato Ferrate (III) | 55 g |
| Disodium Ethylenediaminetetraacetate | 5 g |
| Ammonium Bromide | 40 g |
| Nitric Acid (67%) | 30 g |
| Water to make | 1,000 ml |
| pH (25° C.) (adjusted with acetic acid and aqueous ammonia) | 4.8 |

Rinsing Solution (tank solution and replenisher are the same)

Ion Exchange Water (each concentration of calcium and magnesium is 3 ppm or less)

Each of Samples 101 to 127 was subjected to gradation exposure using a sensitometer (FWH Model, color temperature of a light source: 3200 K manufactured by Fuji Photo Film Co., Ltd.) with a three color separation optical wedge for sensitometry. The exposure time was 0.1 second and the exposure amount was 250 CMS.

Then, each sample was subjected to development processing using a processing machine for color paper with the running processing solutions described above.

Evaluation 1: Color Mixing

With each sample subjected to the color development processing, a cyan density (D R/M) in a magenta color forming portion (exposed to green light) having a magenta density of 2.0 was measured. The smaller the D R/M value, the less the cyan component in the magenta color forming portion. Specifically, an extent of the oxidation product of color developing agent which formed in the magenta color forming layer, diffused into the cyan color forming layer and reacted with the cyan coupler is small. This means a small cyan color mixing in the magenta color image, and thus an excellent color reproducibility.

Evaluation 2: Light Fastness

The sample after the development processing was irradiated with a Xenon intermittent light exposure device having illumination of 200,000 lux through an ultraviolet cutting filter [X] which has transmittance of 50% at 420 nm (in case of a small content of ultraviolet ray) or an ultraviolet cutting filter [Y] which has transmittance of 50% at 300 nm (in case of a large content of ultraviolet ray) for 8 days. After the irradiation, a cyan density was measured at the portion having the cyan density of 2.0 before the irradiation and a remaining rate of cyan density (%) was determined.

The results obtained are shown in Tables 3 to 6 below.

TABLE 3

| Sample | 101 | 102 | 103 | 104 | 105 | 106 | 107 |
|---|---|---|---|---|---|---|---|
| Coupler of Formula (1) | C-1 | C-1 | C-1 | C-1 | C-1 | C-1 | C-1 |
| Compound of Formula (A) | A-3 | A-3 | A-3 | A-3 | A-3 | A-3 | — |
| Amount (mol % to Coupler) | — | 5 | 10 | 15 | 20 | 30 | — |
| Compound of Formula (D) | — | — | — | — | — | — | D-5 |
| Amount (weight ratio to Solv-9) | — | — | — | — | — | — | 0.2 |
| Color Mixing (D R/M) | 0.61 | 0.62 | 0.62 | 0.63 | 0.64 | 0.64 | 0.56 |
| Light Fastness (Remaining Rate %) | | | | | | | |
| UV Filter [X] | 74 | 77 | 79 | 83 | 76 | 73 | 74 |

TABLE 3-continued

| Sample | 101 | 102 | 103 | 104 | 105 | 106 | 107 |
|---|---|---|---|---|---|---|---|
| UV Filter [Y] | 55 | 60 | 61 | 65 | 67 | 67 | 56 |
| Remarks | Comparison | Comparison | Comparison | Comparison | Comparison | Comparison | Comparison |

TABLE 4

| Sample | 108 | 109 | 110 | 111 | 112 | 113 | 114 |
|---|---|---|---|---|---|---|---|
| Coupler of Formula (1) | C-1 | C-1 | C-1 | C-1 | C-1 | C-1 | C-1 |
| Compound of Formula (A) | — | — | — | — | A-2 | A-2 | A2 |
| Amount (mol % to Coupler) | — | — | — | — | 5 | 10 | 25 |
| Compound of Formula (D) | D-5 | D-5 | D-5 | D-5 | D-5 | D-5 | D-5 |
| Amount (weight ratio to Solv-9) | 0.4 | 0.6 | 0.8 | 1.0 | 0.2 | 0.4 | 0.6 |
| Color Nixing (D R/M) | 0.55 | 0.54 | 0.54 | 0.55 | 0.56 | 0.54 | 0.54 |
| Light Fastness (Remaining Rate %) | | | | | | | |
| UV Filter [X] | 76 | 80 | 82 | 84 | 89 | 94 | 97 |
| UV Filter [Y] | 58 | 60 | 59 | 58 | 78 | 85 | 87 |
| Remarks | Comparison | Comparison | Comparison | Comparison | Present Invention | Present Invention | Present Invention |

TABLE 5

| Sample | 115 | 116 | 117 | 118 | 119 | 120 | 121 |
|---|---|---|---|---|---|---|---|
| Coupler of Formula (1) | C-25 | C-25 | C-25 | C-25 | C-25 | C-25 | C-25 |
| Compound of Formula (A) | — | A-22 | — | A-7 | A-7 | A-7 | A-1 |
| Amount (mol % to Coupler) | — | 10 | — | 5 | 10 | 20 | 20 |
| Compound of Formula (D) | — | — | D-6 | D-6 | D-6 | D-6 | D-6 |
| Amount (weight ratio to Solv-9) | — | — | 0.4 | 0.2 | 0.4 | 0.6 | 0.4 |
| Color Mixing (D R/M) | 0.60 | 0.62 | 0.58 | 0.57 | 0.55 | 0.54 | 0.55 |
| Light Fastness (Remaining Rate %) | | | | | | | |
| UV Filter [X] | 75 | 78 | 79 | 88 | 93 | 95 | 90 |
| UV Filter [Y] | 58 | 64 | 59 | 78 | 86 | 90 | 84 |
| Remarks | Comparison | Comparison | Comparison | Present Invention | Present Invention | Present Invention | Present Invention |

TABLE 6

| Sample | 122 | 123 | 124 | 125 | 126 | 127 |
|---|---|---|---|---|---|---|
| Coupler of Formula (1) | C-4 | C-4 | C-6 | C-6 | C-23 | C-23 |
| Compound of Formula (A) | — | A-15 | — | A-20 | — | A-21 |
| Amount (mol % to Coupler) | — | 15 | — | 15 | — | 15 |
| Compound of Formula (D) | — | D-13 | — | D-20 | — | D-34 |
| Amount (weight ratio to Solv-9) | — | 0.4 | — | 0.4 | — | 0.4 |
| Color Mixing (D R/M) | 0.61 | 0.56 | 0.59 | 0.56 | 0.60 | 0.55 |
| Light Fastness (Remaining Rate %) | | | | | | |

TABLE 6-continued

| Sample | 122 | 123 | 124 | 125 | 126 | 127 |
|---|---|---|---|---|---|---|
| UV Filter [X] | 73 | 89 | 75 | 90 | 71 | 92 |
| UV Filter [Y] | 60 | 79 | 57 | 82 | 61 | 84 |
| Remarks | Comparison | Present Invention | Comparison | Present Invention | Comparison | Present Invention |

From the results shown in Tables 3 to 6, it can be seen that when the compound of the formula (A) is used together with the cyan coupler of the formula (1) but without using the compound of the formula (D), the improvement in the light fastness of the cyan color image against the light having a large content of ultraviolet ray (in case of Filter [Y]) is recognized but the extent thereof is small. Further, with respect to the light fastness of the cyan color image against the light having a small content of ultraviolet ray (in case of Filter [X]), although the improvement is observed in case of using a small amount of the compound of the formula (A), the light fastness tends to degrade as increase in the amount thereof. Simultaneously, the cyan density in the magenta color forming portion increases which results in the problem in color reproduction. On the other hand, when the compound of the formula (D) is used together with the cyan coupler of the formula (1) but without using the compound of the formula (A), the light fastness of the cyan color image rather degradates.

On the contrary, it is apparent that when the cyan coupler of the formula (1) is used in combination with the compound of the formula (A) and the compound of the formula (D) according to the present invention, the superadditive effect takes place and the cyan color image which is excellent in color reproduction and fastness to light in a broad wavelength range extending from ultraviolet to visible is obtained.

While the invention has been described in detail and with reference to specific embodiments thereof, it will be apparent to one skilled in the art that various changes and modifications can be made therein without departing from the spirit and scope thereof.

What is claimed is:

1. A sliver halide color photographic light-sensitive material comprising a support having provided thereon at least one silver halide emulsion layer containing at least one cyan dye forming coupler represented by the formula (1) shown below, at least one compound represented by the formula (A) shown below and at least one compound represented by the formula (D) shown below:

(1)

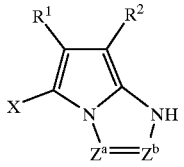

wherein $Z^a$ and $Z^b$ each represents —C($R^3$)═ or —N═, provided that one of $Z^a$ and $Z^b$ is —N═ and the other is —C($R^3$)═; $R^1$ and $R^2$ each represents an electron attractive group having a Hammett's substituent constant $\sigma_p$ value of 0.20 or more and the sum of the $\sigma_p$ values of $R^1$ and $R^2$ is 0.65 or more; $R^3$ represents a hydrogen atom or a substituent; X represents a hydrogen atom or a group capable of being released upon a coupling reaction with an oxidation product of an aromatic primary amine color developing agent; and group represented by $R^1$, $R^2$, $R^3$ or X may be a divalent group to form a dimer or more, or combine with a polymer chain to form a homopolymer or a copolymer;

(A)

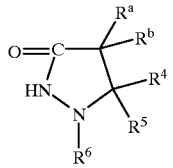

wherein $R^a$ and $R^b$, which may be the same or different, each represents a substituted or unsubstituted aryl group or a substituted or unsubstituted alkyl group having the total number of carbon atoms including the substituent(s) of from 2 to 30; $R^4$ and $R^5$, which may be the same or different, each represents a hydrogen atom, a substituted or unsubstituted alkyl group or a substituted or unsubstituted aryl group; and $R^6$ represents a substituted or unsubstituted aryl group;

(D)

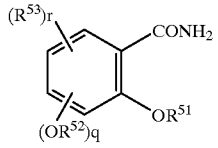

wherein $R^{51}$ and $R^{52}$ each represents a substituted or unsubstituted alkyl group, a substituted or unsubstituted aryl group, a substituted or unsubstituted acyl group, a substituted or unsubstituted carbamoyl group or a substituted or unsubstituted alkoxycarbonyl group; $R^{53}$ represents a halogen atom, a substituted or unsubstituted alkyl group, a substituted or unsubstituted aryl group, a substituted or unsubstituted acyl group, a substituted or unsubstituted carbamoyl group, a substituted or unsubstituted alkoxycarbonyl group, a substituted or unsubstituted sulfonyl group or a substituted or unsubstituted sulfamoyl group; at least one of $R^{51}$, $R^{52}$ and $R^{53}$ is or contains as a substituent a diffusion-resistant group having from 8 to 22 carbon atoms; q represents an integer of from 0 to 2; r represents an integer of from 0 to 4; and provided that the sum of q and r is 4 or less.

2. A silver halide color photographic light-sensitive material as claimed in claim 1, wherein the substituent represented by $R^3$ is a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group or an acyl group.

3. A silver halide color photographic light-sensitive material as claimed in claim 1, wherein the electron attractive group represented by $R^1$ or $R^2$ is an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having the $\sigma_p$ value of 0.20 or more, a heterocyclic group, a halogen atom, an azo group, or a selenocyanate group.

4. A silver halide color photographic light-sensitive material as claimed in claim 1, wherein the group capable of being released is a halogen atom, an alkoxy group, an aryloxy group, an acyloxy group, an alkyl or aryl sulfonyloxy group, an acylamino group, an alkyl or aryl sulfonamido group, an alkoxycarbonyloxy group, an aryloxycarbonyloxy group, an alkyl, aryl or heterocyclic thio group, a carbamoylamino group, a carbamoyloxy group, a heterocyclic carbonyloxy group, a 5-membered or 6-membered nitrogen-containing heterocyclic group, an imido group, or an arylazo group.

5. A silver halide color photographic light-sensitive material as claimed in claim 1, wherein the cyan dye forming coupler is represented by the following formula (4):

(4)

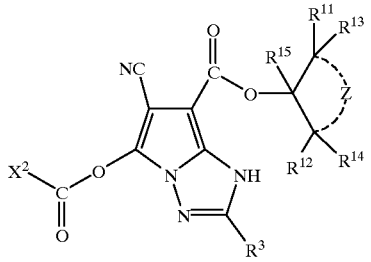

wherein $R^{11}$, $R^{12}$, $R^{13}$, $R^{14}$ and $R^{15}$, which may be the same or different, each represents a hydrogen atom or a substituent; Z represents a non-metallic atom necessary to form a 5-membered to 8-membered ring; $R^3$ represents a hydrogen atom or a substituent; and $X^2$ represents a hydrogen atom or a substituent.

6. A silver halide color photographic light-sensitive material as claimed in claim 5, wherein $R^{11}$ and $R^{12}$ each represents an aliphatic group; and $R^{13}$, $R^{14}$ and $R^{15}$ each represents a hydrogen atom or an aliphatic group.

7. A silver halide color photographic light-sensitive material as claimed in claim 5, wherein the ring formed with Z is a cyclohexane ring.

8. A silver halide color photographic light-sensitive material as claimed in claim 5, wherein $X^2$ is a heterocyclic group, an unsubstituted or substituted amino group or an aryl group.

9. A silver halide color photographic light-sensitive material as claimed in claim 1, wherein $R^a$ is a hydrogen atom, $R^b$ is an alkyl group, both $R^4$ and $R^5$ are hydrogen atoms, and $R^6$ is an aryl group in the formula (A).

10. A silver halide color photographic light-sensitive material as claimed in claim 1, wherein the compound represented by the formula (A) has a ballast group in at least one of $R^a$, $R^b$, $R^4$, $R^5$ and $R^6$.

11. A silver halide color photographic light-sensitive material as claimed in claim 1, which further contains a high boiling point organic solvent.

12. A silver halide color photographic light-sensitive material as claimed in claim 11, wherein the high boiling point organic solvent is a phosphoric acid ester or an amide.

13. A silver halide color photographic light-sensitive material as claimed in claim 12, wherein the phosphoric acid ester is a compound represented by the following formula (SP):

(SP)

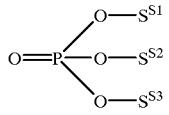

wherein $R^{S1}$, $R^{S2}$ and $R^{S3}$, which may be the same of different, each represents a substituted or unsubstituted alkyl group or a substituted or unsubstituted phenyl group.

14. A silver halide color photographic light-sensitive material as claimed in claim 12, wherein the amide is a compound represented by the following formula (SA):

(SA)

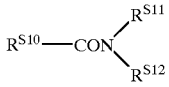

wherein $R^{S10}$ and $R^{S11}$, which may be the same or different, each represents a substituted or unsubstituted alkyl group or a substituted or unsubstituted phenyl group; and $R^{S12}$ represents a hydrogen atom, a substituted or unsubstituted alkyl group or a substituted or unsubstituted phenyl group.

15. A silver halide color photographic light-sensitive material as claimed in claim 14, wherein the amide is a compound represented by the following formula (SA-I):

(SA-I)

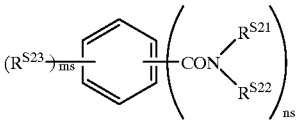

wherein $R^{S21}$ and $R^{S22}$, which may be the same or different, each represents an alkyl group; $R^{S23}$ represents a substituent; ns represents an integer of from 1 to 6; and ms represents an integer of from 0 to 5.

16. A silver halide color photographic light-sensitive material as claimed in claim 11, which further contains a color fading preventing agent, a competing compound, a cyan stain preventing agent or a phenolic cyan coupler.

17. A silver halide color photographic light-sensitive material as claimed in claim 1, wherein the silver halide emulsion layer contains a silver chloride or silver chlorobromide emulsion having a silver chloride content of 95% or more.

18. A silver halide color photographic light-sensitive material as claimed in claim 9, wherein $R^b$ is an unsubstituted alkyl group having 12 to 24 carbon atoms.

19. A silver halide color photographic light-sensitive material as claimed in claim 1, wherein, in the formula (D), $R^{51}$ and $R^{52}$ each is a substituted or unsubstituted alkyl group or a substituted or unsubstituted acyl group, and $R^{53}$ is a halogen atom, a substituted or unsubstituted alkyl group, a substituted or unsubstituted acyl group, a substituted or unsubstituted carbamoyl group or a substituted or unsubstituted alkoxycarbonyl group.

20. A silver halide color photographic light-sensitive material as claimed in claim 19, wherein $R^{51}$ is a substituted or unsubstituted alkyl group having the total number of carbon atoms of 8 to 30 or a substituted or unsubstituted acyl group having the total number of the carbon atoms of 8 to 30, q is 0, r is 0 or 1, and $R^{53}$ is a halogen atom.

* * * * *